US007209684B2

(12) United States Patent
Shimmura et al.

(10) Patent No.: US 7,209,684 B2
(45) Date of Patent: Apr. 24, 2007

(54) IMAGE FORMING APPARATUS AND METHOD FOR FORMING IMAGE WITH DEVELOPING AGENT HAVING ADHESIVE STRENGTH

(75) Inventors: Shoko Shimmura, Yokohama (JP); Minoru Yoshida, Machida (JP); Takeshi Watanabe, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 39 days.

(21) Appl. No.: 11/166,157

(22) Filed: Jun. 27, 2005

(65) Prior Publication Data

US 2006/0291902 A1 Dec. 28, 2006

(51) Int. Cl.
*G03G 15/06* (2006.01)

(52) U.S. Cl. ..... 399/222

(58) Field of Classification Search ..... 399/149, 399/222

See application file for complete search history.

(56) References Cited

FOREIGN PATENT DOCUMENTS

| | | | |
|---|---|---|---|
| JP | 2002-328484 A | | 11/2002 |
| JP | 2003-084489 A | | 3/2003 |
| JP | 2003-098729 A | | 4/2003 |
| JP | 2003215836 A | * | 7/2003 |
| JP | 2004-013049 A | | 1/2004 |
| JP | 2004-101753 A | | 4/2004 |

OTHER PUBLICATIONS

U.S. Appl. No. 11/156,632, filed Jun. 21, 2005, Shimmura.

* cited by examiner

*Primary Examiner*—Susan Lee
(74) *Attorney, Agent, or Firm*—Foley & Lardner LLP

(57) ABSTRACT

The ratio of the particles of developing agent having a particle diameter of not more than A×0.5 (μm) (wherein A is a 50% average particle diameter (μm)) and the ratio of the particles of developing agent having a particle diameter of not less than A×1.5 (μm) (wherein A is a 50% average particle diameter (μm)) are both confined to not more than 5% by number in a number particle size distribution, the ratio of the developing agent having an adhesive strength of not more than $1.3\times10^{-8}$(N) is confined to 10% by weight or less and the ratio of the developing agent having an adhesive strength of not less than $3\times10^{-7}$(N) is confined to 5% by weight or less in a distribution of adhesive strength to the surface of the image carrier.

16 Claims, 7 Drawing Sheets

IMAGE FORMING APPARATUS AND METHOD FOR FORMING IMAGE WITH DEVELOPING AGENT HAVING ADHESIVE STRENGTH

BACKGROUND OF THE INVENTION

This invention relates to an image forming apparatus for developing an electrostatic image or a magnetic latent image in an electrophotographic method, an electrostatic printing method, or a magnetic recording method, and also to a method for forming an image where the image forming apparatus is employed.

When an image is to be formed by means of an electrophotographic system and if a two-component dry developing method is to be employed, a particulate toner is delivered from a developing apparatus and transferred via a carrier, an image carrier and, optionally, a transfer medium such as in intermediate transferring member, etc., to a recording material. Then, the toner on the recording material is subjected to heat and pressure so as to be fixed on the recording material. The toner in this case is enabled to adhere onto each transferring medium through electrostatic force to be derived from the quantity of electric charge each toner particle has, van der Waals force, and liquid cross-linking force, i.e. adhesive strength to be effected by water or moisture. The toner is transferred mainly through the mechanism that toner once adhered to one of the transferring mediums is separated by the effect of external electric field and then permitted to adhere to a succeeding transferring medium. The toner is ultimately transferred over a recording medium such as paper and fixed as a pattern on the recording medium to form an image thereon. In order to efficiently transfer the toner to obtain a final image of high quality, it is desirable to control the adhesive strength of toner to the transferring mediums.

As for the method of forming an image through the control of adhesive strength of toner, there has been proposed a method of forming an image as shown in JP Laid-open Patent Publication (Kokai) No. 2002-328484 wherein the relationship among the adhesive strength between the toner and an image carrier, an average particle size of toner, and the quantity of electrification is confined. In this case, there has been proposed a method of calculating the aforementioned adhesive strength from the centrifugal force which is required to separate the toner from a transferring medium and which can be derived through the employment of a centrifugal separator.

Alternatively, JP Laid-open Patent Publication (Kokai) No. 2004-1011753, for example, describes a method of improving the transferring properties of toner wherein the toner is regulated to meet the condition of: $F/2\sigma>10$ as the toner is subjected to centrifugal separation (wherein F is an average value in the distribution of toner adhesive strength to be obtained from the measurement of adhesive strength of toner after the tone is pressed onto the surface of an image carrier at a predetermine pressure; and $\sigma$ is a standard deviation). In this method, it is intended that the distribution of toner adhesive strength to be measured under specific conditions is greatly sharpened thereby to suppress non-uniformity of the transferring properties of toner and to make it possible to perform the transferring of toner efficiently and very precisely.

However, since this distribution of toner adhesive strength is confined to an extremely narrow range, e.g. the a standard deviation $\sigma$ is required to be not more than $0.3\times10^{-8}$ as the average adhesive strength is $6\times10^{-8}$N, the manufacture of toner becomes very difficult. Further, although it may be possible to enlarge the distribution of toner adhesive strength to a certain extent by increasing the average adhesive strength, if the toner adhesive strength is increased too high, the transferring electric field required for the transfer of toner would become very high, thereby giving rise to risk of aerial discharge. Further, according to this measuring method, it is required to employ a step of pressing toner onto a recording material prior to the measurement of the adhesive strength in order to reproduce the transferring pressure. According to this measuring method however, it is impossible to grasp the behavior of the toner which is weak in adhesive strength, i.e. the toner which can be separated from an image carrier as the toner is subjected to weak transferring electric field immediately before the toner is introduced into the transferring nip. Moreover, according to this technique, there are possibilities that a small quantity of toner particle exhibiting an adhesive strength which differs greatly from the average adhesive strength may be included in the toner. Toner particle exhibiting considerably large adhesive strength may become a cause for generating residual toner after the step of transferring the toner. On the other hand, toner particle exhibiting considerably small adhesive strength may become a cause for generating the scattering of toner to a periphery of image. Because of these reasons, even with the employment of this technique, there are problems with regard to the transferring efficiency and quality of image.

In the cleaner-less process where a mechanism for recovering residual toner concurrent with the development of image, when the toner is caused to leave behind after the transferring step thereof, the succeeding electrification step and latent image-forming step are permitted to undergo without the residual toner being removed, after which the residual toner in the non-imaging regions is recovered by a developing device concurrent with the development of new image regions. Therefore, if the quantity of residual toner after the transferring step is large, it may become causes for generating a defective image due to the incidents that the light source for forming a latent image may be obstructed, the recovery of toner by the developing device may become insufficient, and the generation of undesirable retransferring.

In the case of a color image forming apparatus of tandem structure, the toner that has been transferred to an intermediate transferring medium for example from an image carrier may happen to be reversely transferred to an image carrier of succeeding stage when the toner is subjected to a transferring electric field in the transferring region of the image carrier of succeeding stage and, at the same time, is press-contacted with the succeeding image carrier. Once this reversely transferred toner is recovered by the developing device in the cleaner-less process, the toner having the color of the developing station of the preceding stage is permitted to enter into the developing device of the succeeding stage, thereby making it impossible to perform the management of color if the toner entering into the developing device of the succeeding stage is increased. The transferring efficiency frequently conflicts in nature with the reverse transferring efficiency. Therefore, in order to prevent such a situation where the color mixing due to the reverse transferring become too prominent to recover, it is required to adopt transferring conditions which make it possible to prevent the reverse transferring even at the sacrifice, to a certain extent, of the transferring performance.

In view of these problems, there has been proposed a technique to make the adhesive strength between a resin matrix particle and an image carrier smaller than the adhesive strength between resin matrix particles and also than the adhesive strength between the resin matrix particle and a transferring body as described in JP Laid-open Patent Publication (Kokai) No. 2003-98729.

Further, there has been also proposed a technique to make the adhesive strength between a first transferring body and toner larger than the adhesive strength between an image carrier and toner and also than the adhesive strength between the first transferring body and a resin matrix particle as described in JP Laid-open Patent Publication (Kokai) No. 2003-84489.

However, since these adhesive strengths are not uniform just like the fact that toner is not uniform in particles size, it has been difficult to sufficiently meet the relationships in magnitude of adhesive strength among the toner, the resin matrix particle and the first transferring body. Further, even if it is possible to satisfy these relationships on the basis of average adhesive strengths, it has been difficult to sufficiently control the residue of transcription or the reverse transcription.

BRIEF SUMMARY OF THE INVENTION

Objects of the present invention are to provide a technique which is capable of forming a high-quality image without dust of toner at an excellent transferring efficiency and is sufficiently applicable to a cleaner-less process, and to provide a technique which is capable of forming a high-quality color image without dust of toner at an excellent transferring efficiency, is capable of preventing reverse transferring and color mixture resulting from the reverse transferring, and is sufficiently applicable to a cleaner-less process.

According to a first aspect of the present invention, there is provided an image forming apparatus comprises an image carrier, a developing portion for feeding particles of developing agent (or developing particle) to a static latent image to enable the developing agent to adhere onto the surface of an image carrier to thereby form an developing agent image, and a transferring portion for transferring the developing agent image to a transferring medium;

wherein the ratio of the particles of developing agent having a particle diameter of not more than A×0.5 (μm) (wherein A is a 50% average particle diameter (μm)) and the ratio of the particles of developing agent in the distribution has a particle diameter of not less than A×1.5 (μm) (wherein A is a 50% average particle diameter (μm)) are both confined to not more than 5% by number in a number particle size distribution;

the ratio of the developing agent having an adhesive strength of not more than $1.3\times10^{-8}$(N) is confined to 10% by weight or less and the ratio of the developing agent having an adhesive strength of not less than $3\times10^{-7}$(N) is confined to 5% by weight or less in a distribution of adhesive strength to the surface of the image carrier.

According to a second aspect of the present invention, there is provided an image forming apparatus comprises an image carrier, a developing portion for feeding particles of developing agent (or developing particle) to a static latent image to enable the developing agent to adhere onto the surface of an image carrier to thereby form an developing agent image, and a transferring portion for transferring the developing agent image to a transferring medium;

wherein the developing portion is further provided with a mechanism for recovering therein residual developing agent existing on the image carrier concurrent with the development;

the ratio of the particles of developing agent having a particle diameter of not more than A×0.5 (μm) (wherein A is a 50% average particle diameter (μm)) and the ratio of the particles of developing agent having a particle diameter of not less than A×1.5 (μm) (wherein A is a 50% average particle diameter (μm)) are both confined to not more than 4% by number in a number particle size distribution;

the ratio of the developing agent having an adhesive strength of not less than $3\times10^{-7}$(N) is confined to 4% by weight or less in a distribution of adhesive strength to the surface of the image carrier.

According to a third aspect of the present invention, there is provided a color image forming apparatus comprising image carriers, two or more developing portions for feeding plural kinds, differing in color, of developing agent to static latent images formed on the image carriers respectively to enable the developing agent to adhere onto the surface of each of image carriers to thereby form developing agent images differing in color, and transferring portions for transferring the developing agent images to each of transferring mediums;

wherein the ratio of the particles of developing agent having a particle diameter of not more than A×0.5 (μm) (wherein A is a 50% average particle diameter (μm)) is confined to not more than 3% by number in a number particle size distribution;

the ratio of the developing agent having an adhesive strength of not more than $1.3\times10^{-8}$(N) is confined to 5% by weight or less in a distribution of adhesive strength to the surface of the image carrier.

According to a fourth aspect of the present invention, there is provided a color image forming apparatus comprising image carriers, two or more developing portions for feeding plural kinds, differing in color, of developing agent to static latent images formed on the image carriers respectively to enable the developing agent to adhere onto the surface of each of image carriers to thereby form developing agent images differing in color, and transferring portions for transferring the developing agent images to each of transferring mediums;

wherein the developing portion is further provided with a mechanism for recovering therein residual developing agent existing on the image carrier concurrent with the development;

the ratio of the particles of developing agent having a particle diameter of not more than A×0.5 (μm) (wherein A is a 50% average particle diameter (μm)) is confined to not more than 2% by number in a number particle size distribution;

the ratio of the developing agent having an adhesive strength of not more than $1.3\times10^{-8}$(N) is confined to 3% by weight or less in a distribution of adhesive strength to the surface of the image carrier.

According to a fifth aspect of the present invention, there is provided a method of forming an image, which comprises the steps of: developing an developing agent image on an image carrier by feeding particles of developing agent accommodated in a developing portion to a static latent image to enable the developing agent to adhere onto the surface of an image carrier, and transferring the developing agent image to a transferring medium;

wherein the ratio of the particles of developing agent having a particle diameter of not more than A×0.5 (μm) (wherein A is a 50% average particle diameter (μm)) and the ratio of the particles of developing agent having a particle diameter of not less than A×1.5 (μm) (wherein A is a 50% average particle diameter (μm)) are both confined to not more than 5% by number in a number particle size distribution;

the ratio of the developing agent having an adhesive strength of not more than $1.3\times10^{-8}$(N) is confined to 10% by weight or less and the ratio of the developing agent having an adhesive strength of not less than $3\times10^{-7}$(N) is confined to 5% by weight or less in a distribution of adhesive strength to the surface of the image carrier.

According to a sixth aspect of the present invention, there is provided a method of forming an image, which comprises the steps of: developing an developing agent image on an image carrier by feeding particles of developing agent accommodated in a developing portion to a static latent image to enable the developing agent to adhere onto the surface of an image carrier, and transferring the developing agent image to a transferring medium;

wherein the step of development further comprises a step of recovering residual developing agent existing on the image carrier in the developing portion concurrent with the development;

the ratio of the particles of developing agent having a particle diameter of not more than A×0.5 (μm) (wherein A is a 50% average particle diameter (μm)) and the ratio of the particles of developing agent having a particle diameter of not less than A×1.5 (μm) (wherein A is a 50% average particle diameter (μm)) are both confined to not more than 4% by number in a number particle size distribution;

the ratio of the developing agent having an adhesive strength of not less than $3\times10^{-7}$(N) is confined to 4% by weight or less in a distribution of adhesive strength to the surface of the image carrier.

According to a seventh aspect of the present invention, there is provided a method of forming a color image, which comprises: two or more steps of developing images of developing agents differing in color by feeding developing agents from two or more developing portions to static latent images, respectively, formed on the image carriers to enable the developing agent to adhere onto the surface of each of image carriers to thereby form developing agent images differing in color, steps of transferring the developing agent images differing in color to a transferring medium, and steps of fixing the images of transferred developing agents on the transferring medium;

wherein the ratio of the particles of developing agent having a particle diameter of not more than A×0.5 (μm) (wherein A is a 50% average particle diameter (μm)) is confined to not more than 3% by number in a number particle size distribution;

the ratio of the developing agent having an adhesive strength of not more than $1.3\times10^{-8}$(N) is confined to 5% by weight or less in a distribution of adhesive strength to the surface of the image carrier.

According to an eighth aspect of the present invention, there is provided a method of forming a color image, which comprises: two or more steps of developing images of developing agents differing in color by feeding developing agents from two or more developing portions to static latent images, respectively, formed on the image carriers to enable the developing agent to adhere onto the surface of each of image carriers to thereby form developing agent images differing in color, steps of transferring the developing agent images differing in color to a transferring medium, and steps of fixing the images of transferred developing agents on the transferring medium;

wherein the step of development further comprises a step of recovering residual developing agent existing on the image carrier in the developing portion concurrent with the development;

the ratio of the particles of developing agent having a particle diameter of not more than A×0.5 (μm) (wherein A is a 50% average particle diameter (μm)) is confined to not more than 2% by number in a number particle size distribution, the ratio of the developing agent having an adhesive strength of not more than $1.3\times10^{-8}$(N) is confined to 3% by weight or less in a distribution of adhesive strength to the surface of the image carrier.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Figure 1:
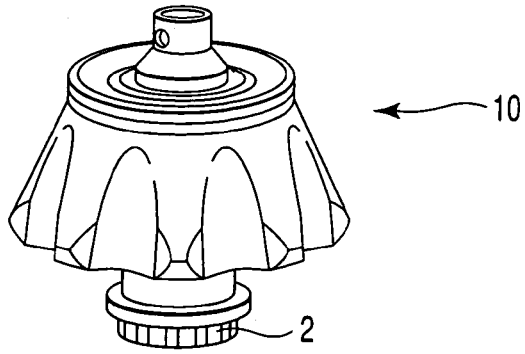
FIG. 1 is a perspective view showing an external appearance of an angle rotor.

The present invention can be classified into the following eight aspects.

The image forming apparatus according to the present invention fundamentally comprises an image carrier, a developing portion for feeding particles of developing agent to an electrostatic latent image to enable the developing agent to adhere onto the surface of an image carrier to thereby form an developing agent image, and a transferring portion for transferring the developing agent image to a transferring medium, wherein the non-uniformity in number particle size distribution of each developing particle as well as the non-uniformity in adhesive strength between each of the developing agent to be employed and the surface of image carrier is regulated according to the following first to fourth conditions, respectively.

Further, the method of forming an image according to the present invention fundamentally comprises the steps of: developing an developing agent image on an image carrier by feeding particles of developing agent accommodated in a developing portion to an electrostatic latent image to enable the developing agent to adhere onto the surface of an image carrier, and transferring the developing agent image to a transferring medium; wherein the non-uniformity in number particle size distribution of each developing particle as well as the non-uniformity in adhesive strength between each of the developing agent to be employed and the surface of image carrier is regulated according to the following first to fourth conditions, respectively.

The first condition is regulated as follows. Namely, a number particle size distribution which is configured such that the ratio of the particles of developing agent having a particle diameter of not more than A×0.5 (μm) (wherein A is a 50% average particle diameter (μm)) and the ratio of the particles of developing agent having a particle diameter of not less than A×1.5 (μm) (wherein A is a 50% average particle diameter (μm)) are both confined to not more than 5% by number;

the ratio of the developing agent having an adhesive strength of not more than $1.3\times10^{-8}$(N) is confined to 10% by weight or less and the ratio of the developing agent having an adhesive strength of not less than $3\times10^{-7}$(N) is confined to 5% by weight or less in a distribution of adhesive strength to the surface of the image carrier.

The second condition is applicable to the case where the developing portion is further provided with a mechanism for recovering therein residual developing agent existing on the image carrier concurrent with the development, the second condition being regulated as follows. Namely, the ratio of the particles of developing agent having a particle diameter of not more than A×0.5 (μm) (wherein A is a 50% average particle diameter (μm)) and the ratio of the particles of developing agent having a particle diameter of not less than A×1.5 (μm) (wherein A is a 50% average particle diameter (μm)) are both confined to not more than 4% by number in a number particle size distribution; the ratio of the developing agent having an adhesive strength of not less than $3\times10^{-7}$(N) is confined to 4% by weight or less in a distribution of adhesive strength to the surface of the image carrier.

The third condition is applicable to the formation of a color image and regulated as follows. Namely, the ratio of the particles of developing agent having a particle diameter of not more than A×0.5 (μm) (wherein A is a 50% average particle diameter (μm)) is confined to not more than 3% by number in a number particle size distribution; the ratio of the developing agent having an adhesive strength of not more than $1.3\times10^{-8}$(N) is confined to 5% by weight or less in a distribution of adhesive strength to the surface of the image carrier.

The fourth condition is applicable to the formation of a color image where the developing portion is further provided with a mechanism for recovering therein residual developing agent existing on the image carrier concurrent with the development, the fourth condition being regulated as follows. Namely, the ratio of the particles of developing agent having a particle diameter of not more than A×0.5 (μm) (wherein A is a 50% average particle diameter (μm)) is confined to not more than 2% by number in a number particle size distribution; the ratio of the developing agent having an adhesive strength of not more than $1.3\times10^{-8}$(N) is confined to 3% by weight or less in a distribution of adhesive strength to the surface of the image carrier.

The present inventors have found out through experiments that the number particle size distribution of toner as well as a distribution of adhesive strength of toner are strongly correlated with the transfer properties of toner and that when these distributions are regulated to meet the aforementioned first condition, it is possible to realize not only excellent transferring efficiency but also excellent image quality.

Since particles of developing agent which is large in particle diameter respectively have large electric charge, the electrostatic adhesive strength is large and van der Waals force is also large in proportion to the particle diameter. The adhesive strength of developing agent can be represented by the following formula.

$$F=Kq^2+Fv+Fb$$

wherein

K: Constant related to surface density of charge q: Electric charge each particle of developing agent has $Fe=Kq^2$: Electrostatic adhesive strength Fv: Van der Waals force Fb: Liquid crosslinking force When the surface density of charge is assumed as being the same with each other, since electrostatic attraction is directly proportional to $q^2$, the electrostatic attraction varies with 4-th power of particle diameter and van der Waals force varies with first power of particle diameter. Further, since the force of electric field which charged particle receives varies directly with the quantity of electric charge, the force of electric field vary with the square of particle diameter.

Therefore, when the particle diameter of developing agent is increased 1.5 times, the adhesive strength of developing agent to the image carrier would be increased 3.9 times and the attractive force thereof toward the transferring medium would be increased about 2.2 times. Therefore, since the adhesive strength of developing agent to the image carrier is about twice as high as the attractive force thereof toward the transferring medium, thereby rendering the developing agent difficult to transfer and hence inviting much possibilities that the developing agent is caused to remain untransferred as residual developing agent. On the other hand, when the particle diameter of developing agent is reduced 0.5 times, the adhesive strength of developing agent to the image carrier would be reduced 1/16 and the attractive force thereof toward the transferring medium would be reduced 1/4, thus rendering the transferring force four times higher than the adhesive strength of developing agent to the image carrier. As a result, the developing agent is permitted to initiate the separation thereof from the image carrier and move toward the transferring medium at a position which is remote from the contact point between the image carrier and a transfer bias-impressing member, i.e. the point of maximum electric field. In this case, since the traveling distance of developing agent is longer, it is difficult to enable the developing agent to move precisely to the position on the transferring medium which corresponds to the latent image. As a result, the developing agent is permitted to scatter around the image, causing the deterioration of image to be formed. The particles of developing agent having a particle diameter which is more than 1.5 times higher than 50% average particle diameter are likely to become residual developing agent. Therefore, in order to confine the quantity of residual developing agent after transcription to 3% by weight or less, the ratio of developing agent having a particle diameter which is more than 1.5 times higher than 50% average particle diameter should be confined to not more than 5% by number. The fact that the quantity of residual developing agent is 3% by weight means that it is a maximum quantity which makes it possible to efficiently consume the developing agent to minimize the quantity of developing agent to be discarded, and to prevent the deterioration of developing properties of developing agent even if the developing agent is used for a long period of time on the occasion of recycling the developing agent by recovering and returning residual developing agent back to a developing device according to a recycle system. Further, if the quantity of fine powder having a particle diameter which is not more than 0.5 times as large as 50% average particle diameter is relatively large, the dust of developing agent to be scattered around an image would be relatively increased. Therefore, the quantity of fine powder having a particle diameter which is not more than 0.5 times as large as 50% average particle diameter should be confined to not more than 5% by number in order to reduce the quantity of dust to such a level which can be hardly recognized.

The toner particle of developing agent can be manufactured by means of grinding method or polymerization method. Even in the employment of the polymerization method which is more advantageous in obtaining uniform particle size and uniform component distribution as compared with the grinding method, it is difficult to manufacture toner particle which is uniform in particle diameter, in particle configuration and in components of surface region. Furthermore, there is possibility that non-uniform adhesion of additives is caused to generate in the addition of additives to the surface of toner. The non-uniformity of adhesion of components and additives on the surface region may become a cause for fluctuating the surface density of charge of toner, resulting in variation of the constant K in the aforementioned formula. Further, if the configuration of toner is amorphous and non-uniform, the value of van der Waals force Fv is also caused to vary. Sometimes, the quantity of residual developing agent and the quantity of dust may become larger than a permissible level even if particles of developing agent where particles of larger size and smaller size are eliminated in advance are employed, and the cause of which is assumed to be attributed to the fluctuation of the aforementioned surface density of charge. Therefore, it is difficult to control the adhesive strength of developing agent to the surface of image carrier only through the control of particle diameter of developing agent, so that it is also required to control the distribution of adhesive strength of developing agent. The developing agent exhibiting a strong adhesive strength of not less than $3\times10^{-7}$(N) cannot be separated from the image carrier by means of transferring electric field, thereby becoming a cause for increasing the quantity of residual developing agent. On the contrary, the developing agent exhibiting a weak adhesive strength of not more than $1.3\times10^{-8}$(N) can be easily separated from the image carrier by means of transferring electric field, thereby becoming a cause for increasing the dust around an image.

The degree of dust of developing agent on the occasion of transcription is now assayed using a ratio between the width of fine line developed on the image carrier and the width of fine line obtained from the transfer thereof on a transferring medium. Since the width of fine line obtained after the transfer thereof is caused to increase when the toner is permitted to scatter to deteriorate the image of fine line, it is possible to assay the deterioration in quality of image on the occasion of transfer by measuring any increase in width of fine line after the transfer thereof relative to the width of fine line on the image carrier before the transfer thereof. Herein, a fine line image of 1.5 μm/pixel, 1200 pixel length=1.8 mm was taken up as an electronic data by making use of a CCD camera. Then, on the basis of the profile of reflectance T in the width-wise direction of fine line and under the conditions where white paper portion is defined as T100 and the maximum concentration portion is defined as T0, a width indicating not less than a reflectance of T60 is assumed as being the width of fine line.

By the way, if only the distribution of adhesive strength of toner is controlled, it is sometimes impossible to correlate the results measured of the distribution of adhesive strength between the particles of developing agent and the image carrier with the transferring properties and also with image quality, since the adhesive strength is influenced by various uncertainties such as the fluctuation in magnitude of electric charge, the existence of particles of developing agent which are not contacted directly with the image carrier due to the quantity of development, and the fluctuation of the influence of contamination or scar of the surface of image carrier on the adhesive strength of developing agent. By the way, the fluctuation in magnitude of electric charge is also related to the temperature and moisture of ambient atmosphere, to a state of frictional electrification such as the number of contact, the mixing time and mixing ratio of developing agent with carrier particle, and to the deterioration of the surface of carrier particle.

Whereas, according to the present invention, not only the particle size distribution, but also the distribution of adhesive strength of developing agent is controlled, thereby making it possible to eliminate any influence of the fluctuation of adhesive strength and, at the same time, to prevent the deterioration of image quality that may be caused to occur due to untransferred developing agent and the dust of developing agent.

It is possible, in the formation of image, to employ a cleaning device provided with a rubber blade for instance for recovering residual developing agent after the transcription thereof.

Further, in the formation of image, a recycle mechanism for returning residual developing agent to a developing device and to a toner hopper may be attached to the aforementioned cleaning device.

The second condition according to the present invention is applicable to the formation of image where the developing portion is further provided with a mechanism for recovering therein residual developing agent existing on the surface of image carrier concurrent with the development. Namely, in this process of forming an image employing a mechanism for recovering therein residual developing agent existing on the image carrier concurrent with the development, after finishing the step of transfer, the residual toner is transferred via electrification and exposure steps for forming a succeeding image-forming process to a developing region without being subjected to cleaning. In this developing region, only the toner left remain in the non-image portion in the next electrostatic latent image is recovered into a developing apparatus. In this case, the ratio of the particles of developing agent having a particle diameter of not less than 1.5 A (μm) (wherein A is a 50% average particle diameter (μm)) is confined to not more than 4% by number in a number particle size distribution, the ratio of the developing agent having an adhesive strength of not less than $3\times10^{-7}$(N) is confined to 4% by weight or less in a distribution of adhesive strength to the surface of the image carrier. By regulating the particles of developing agent in this manner, it is possible to prevent the residual developing agent from badly affecting the next image and also to prevent the appearance of the residual developing agent as an image memory. Namely, if the quantity of particles of developing agent for forming an image is too large, it will lead to the difficulties of transfer, to fixing failure due to insufficient heat quantity on the occasion of fixing, or to the generation of offset due to a temperature gradient between the surface region and an inner region of the developing agent image at the contacting portion of developing agent with a fixing roller. Therefore, the quantity of particles of developing agent for forming an image should be confined to not more than appropriate quantity. Generally, the quantity of toner at a solid portion is set to range from 0.6 mg/cm$^2$ to 0.3 mg/cm$^2$. When the toner is to be transferred to paper at a maximum quantity of 0.6 mg/cm$^2$, if the quantity of residual toner on the image carrier is assumed to be 2% by weight based on the entire quantity of toner, it corresponds to a quantity of about 10 μg/cm$^2$. Accordingly, assuming that one particular toner is formed of uniform spherical particle having a specific gravity of 1.1, about 3% of the surface of image carrier is covered by the toner having a particle diameter of 5 μm, or about 2% of the surface of image carrier is covered by the toner having a particle diameter of 7 μm. If the surface coverage is confined to this range of 2–3%, it is possible to obviate the obstruction of electrification and exposure. However, when the quantity of residual toner becomes 2% by weight or more and the surface coverage of image carrier becomes 3% or more, the exposure light would be slightly obstructed so that the residual electric potential would become slightly higher than that of the surface of photoreceptor which is free from residual developing agent, thereby rendering this difference in potential to become a difference in concentration of toner after the development, thus making it possible to visually recognize this difference.

Further, in the case where the developing agent exhibiting a strong adhesive strength to the surface of image carrier is permitted to leave on the surface of image carrier and this developing agent is desired to be recycled, if the adhesive strength of this developing agent is too strong, it is impossible to recover this developing agent, thereby resulting in the generation of positive memory wherein the residual developing agent is enabled to be transferred to a transferring medium in the transferring step for forming the next image. Otherwise, this residual developing agent having a strong adhesive strength is enabled to remain on the image carrier without being transferred or recovered, thereby obstructing the formation of electrostatic latent image or becoming a cause for filming.

Furthermore, even if it is possible to recover this residual developing agent at the developing portion, the toner exhibiting a stronger adhesive strength is accumulated in the developing portion, thereby inviting possibilities of fluctuating the developing properties of toner with a long period of use. Therefore, the quantity of residual developing agent should desirably be confined to 2% by weight or less and the existence of particles of developing agent exhibiting a strong adhesive strength is undesirable. In accordance with the aforementioned second condition, when the particles of developing agent are selected to meet two conditions, i.e. the condition of a number particle size distribution which is configured such that the ratio of the particles of developing agent having a particle diameter of not less than 1.5 times higher than 50% average particle diameter is confined to not more than 4% by number, and the condition of a distribution of adhesive strength to the surface of the image carrier, which is configured such that the ratio of the developing agent having an adhesive strength of not less than $3\times10^{-7}$(N) is confined to 4% by weight or less, it is possible to suppress the quantity of residual developing agent to 2% by weight or less. In this case, it is prevent the developing agent from adhering to or remaining on the surface of image carrier or to prevent the fluctuation of developing properties even if the developing agent is employed for a long period of time.

It is also possible, in this second condition, to further confine the ratio of the developing agent having an adhesive strength of not more than $1.3\times10^{-8}$(N) to 10% by weight or less in the aforementioned distribution of adhesive strength to the surface of the image carrier. When the developing agent is selected in this manner, it is possible to further promote the advantages of the invention, i.e. it is possible to suppress the quantity of dust to less than a visible level and to keep the high quality of image.

The third condition to be employed in the present invention is applied to the formation of a color image where a plurality of developing portions are provided.

In the case of a color image forming system of tandem structure provided with two or more image forming units for respectively forming an image of different color on each of image carriers for example, a first toner image formed on an image carrier by means of a first image forming unit is transferred to a transferring medium at a first transfer region. Subsequently, the transferring medium having the first toner image transferred thereto is moved to a second transfer region of a second image forming unit and a second toner image formed on an image carrier by means of the second image forming unit is transferred to and superimposed over the un-fixed first toner image formed on the transferring medium. This cycle is repeated at a required number of times in conformity with the number of the image forming units to obtain a laminated image consisting of color images employed therein. The resultant laminated image is then fixed as it is when the image forming system is a direct transfer system or is further transferred from an intermediate transfer medium to a transferring medium such as paper when the image forming system is an intermediate transfer system and then fixed to obtain a final image. In the transfer region of the second image forming unit, there are possibilities of generating a phenomenon that the developing agent of the preceding color that has been already transferred onto the transferring material is reversely transferred onto the second image carrier concurrent with the transferring of developing agent of a second color onto the recording material by the effect of transferring electric field. Likewise, the developing agents of the first and second colors may be reversely transferred at a third transfer region, and the developing agents of the first, second and third colors may be reversely transferred at a fourth transfer region. Once the reverse transcription is generated, defectives of image may be caused to generate. For example, the concentration of image of toner image on the transferring medium may be reduced, or the particles of developing agent on a fine line may be lost to deteriorate the sharpness of image. Generally, there is a conflicting feature between the transcription efficiency and the reverse transcription efficiency. However, it is possible, through the control of the quantity of fine powder of developing agent and the distribution of adhesive strength of developing agent to the transferring medium according to the aforementioned third conditions, to optimize the transferring efficiency and the reverse transcription efficiency in the formation of a color image. Since the particles of developing agent having a particle diameter which is not more than 0.5 times as large as 50% average particle diameter are small in quantity of electric charge which each particle is provided with and, at the same time, the van der Waals force thereof is also small in relative to the particle diameter, the adhesive strength of the developing agent is also relatively small. Therefore, the particles of developing agent having such a small size is excellent in transferring efficiency from the image carrier to the transferring medium, but they can be easily reversely transferred again from the transferring medium to the image carrier after they are once transferred to the transferring medium. Therefore, the reverse transcription of developing agent can be suppressed by minimizing the mixing ratio of these fine powders.

Further, even if the particle diameter of developing agent is relatively large, there are possibilities that the particles of developing agent which are low in quantity of electric charge and in adhesive strength are permitted to exist due to non-uniformity of surface components of particle, non-uniformity in configuration of the particles, the degree of adhesion of additives, and scarceness in opportunity of electrification. Therefore, it is also required to remove the particles of low adhesive strength to the transferring medium. On the other hand, if only the distribution of adhesive strength of toner is controlled, it is not always possible to correlate the results measured of the distribution of adhesive strength with the reverse transferring properties, since the adhesive strength between the particles of developing agent that has been transferred and the transferring medium is influenced by various uncertainties such as the fluctuation in magnitude of electric charge to be caused by the temperature and moisture of ambient atmosphere, by a state of frictional electrification such as the number of contact, the mixing time and mixing ratio of developing agent with carrier particle and by the deterioration of the surface of carrier particle; the existence of particles of developing agent which are not contacted directly with the image carrier due to the quantity of development; the fluctuation of resistivity and surface non-uniformity when the transferring medium is formed of a direct transferring paper; and the fluctuation of the adhesive strength of developing agent due to the influence of contamination or scar of the surface of transferring body when the transferring medium is formed of an intermediate transferring body. However, when not only the particle size distribution but also the distribution of adhesive strength is concurrently controlled, it is possible to eliminate the influence of fluctuation of adhesive strength and to prevent the deterioration in quality of image to be caused by the reverse transcription. Problems due to the reverse transcription will be most prominently manifested by the deterioration of fine line, wherein the developing agent is transferred at first with high-image quality to a transferring medium from the image carrier, and then, part of the fine line is removed due to the reverse transcription, thereby generating non-uniformity in the fine line. When the non-uniformity in the longitudinal direction of fine line is assumed as a criterion, as the magnitude of reverse transcription is reduced, the magnitude of non-uniformity can be proportionally reduced. If this non-uniformity is confined to 0.07 or less, the quality of image can be considered as falling within a permissible range. The non-uniformity of fine line is correlated not only with the quantity of fine powder in the number particle size distribution of developing agent but also with the ratio of developing agent having an adhesive strength of not more than $1.3\times10^{-8}$(N) in the distribution of adhesive strength between the particles of developing agent and a transferring medium. In accordance with the aforementioned third condition, when the ratio of the particles of developing agent having a particle diameter of not more than ½ of 50% average particle diameter is confined to not more than 3% in the number particle size distribution of developing agent to be employed, and, at the same time, the ratio of the developing agent having an adhesive strength of not more than $1.3\times10^{-8}$(N) is confined to 5% by weight or less in the distribution of adhesive strength between the developing agent to be employed and the transferring medium, it is possible to prevent the deterioration of fine line that may be caused by the reverse transcription.

The fourth condition according to the present invention is applicable to the formation of color image where the developing portion is further provided with a mechanism for recovering therein residual developing agent existing on the surface of image carrier concurrent with the development.

In the case of forming a color image, it is not only accompanied with the problem of generating defective image due to the generation of reverse transcription as mentioned above, but also accompanied, in particular in the case of cleaner-less process where recovery of residual toner is performed concurrent with the development of image at the developing portion without disposing a cleaning mechanism at a latter stage of the transferring portion of image carrier, with the problem of generating color mixture where the developing agent of the preceding stage that has been reversely transferred is recovered concurrent with the residual developing agent. Therefore, if the quantity of the toner of the previous stage causing color mixture is too large, the hue of the developing device is caused to change, thereby making it impossible to control the color. Therefore, it is desirable, in the case of a color image forming, to take measure to minimize the quantity of reverse transcription as much as possible. The change of color due to color mixture is caused to occur in a process wherein the color toner of previous stage is reversely transferred and recovered by the developing device, thereby enabling this color toner to be mixed with the toner of different color and to be uniformly dispersed in the developing device. In this case, since this color toner is consumed together with the developing agent of originally aimed color, the degree of the accumulation of developing agent of different color in the developing device is caused to vary depending on the ratio of printing rate in the image formation of the previous stage. Generally, when the worst case is assumed by means of simulation of printed image where the rate of color mixture would be most prominent in a possible pattern of printing, the quantity of reverse transcription should be confined to not more than 2% by weight in order to confine the discoloration by the mixture of different colors to a permissible range. The quantity of reverse transcription is correlated not only with the quantity of fine powder in the developing agent but also with the quantity of developing agent having an adhesive strength of not more than $1.3\times10^{-8}$(N) to a transferring medium. According to the aforementioned fourth condition, since the particles of developing agent are selected such that, in a number particle size distribution, the ratio of the particles of developing agent having a particle diameter of not more than ½ of the 50% average particle diameter is confined to not more than 2% by number; and that, in a distribution of adhesive strength between the developing agent and a transferring medium, the ratio of the developing agent having an adhesive strength of not more than $1.3\times10^{-8}$(N) is confined to 3% by weight or less, it is possible to suppress the quantity of reverse transcription to 2% or less.

By the way, when the aforementioned regulation of the third distribution of adhesive strength is applied to each of the aforementioned first and second distributions of adhesive strength, the advantages to be derived from both regulations can be obtained concurrently. Likewise, when the aforementioned regulation of the fourth distribution of adhesive strength is applied to each of the aforementioned first and second distributions of adhesive strength, the advantages to be derived from both regulations can be obtained concurrently.

The measurement of the adhesive strength of toner to be employed in the present invention can be performed for example by mounting an angle rotor (CP100MX; Hitachi Kohki Co., Ltd.) on an ultacentrifugal separator (P100AT2; Hitachi Kohki Co., Ltd.).

Figure 2:
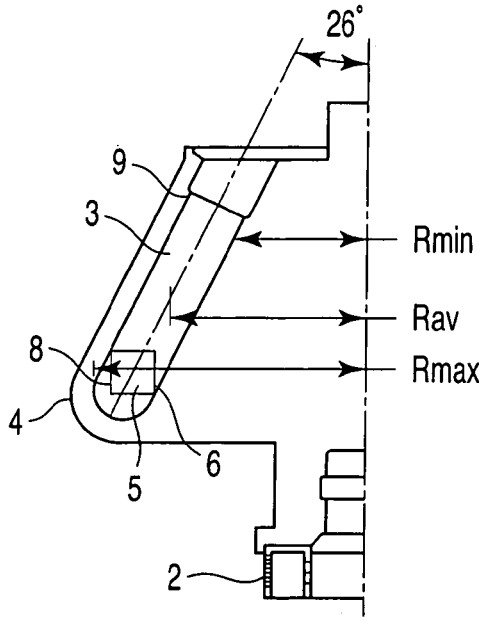
FIG. 2 is a longitudinal cross-sectional view of part of the angle rotor shown in FIG. 1 taken along the rotational axis thereof.
Figure 3:
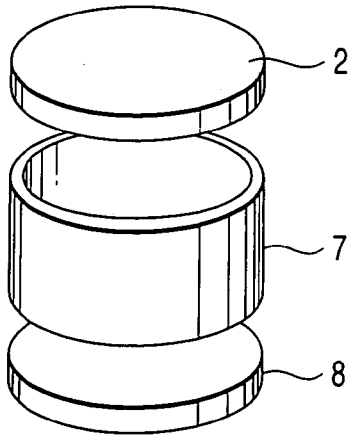
FIG. 3 is an exploded perspective view illustrating the construction of a cell.

FIG. 1 illustrates the external appearance of the angle rotor; FIG. 2 shows a longitudinal cross-sectional view of part of the angle rotor shown in FIG. 1 taken along the rotational axis thereof; and FIG. 3 shows an exploded perspective view illustrating the construction of the cell for mounting a sample in the angle rotor.

As shown in FIGS. 1 and 2, this angle rotor 10 is provided, in the cone-like rotator 4 placed on a base 2, with a cell-holding portion 9 having a pit-like configuration with the central axis thereof being inclined at an angle of 26° relative to the rotational axis 1 of the rotor 10. A cell 3 can be placed and secured in this cell-holding portion 9. The cell 3 may be provided with a sample container 5 for accommodating and separating a sample.

The sample container 5 is constituted by a cylindrical spacer 7, a disc-like sample mounting plate 6 to be disposed on one end of the spacer 7, and a sample-receiving plate 8 for accepting a separated sample. In this cell 3, the sample-receiving plate 8 will be disposed at a location which is remote from the rotational axis, and the sample mounting plate 6 will be disposed at a location which is close to the rotational axis.

First of all, a photosensitive sheet laminated, on the surface thereof, with a surface protecting layer of the same kind as the photoreceptor is prepared. In order to measure the adhesive strength, the surface protecting layer is required to be the same as the photoreceptor. However, in order to reproduce the adhesion of toner to the photoreceptor, a sheet laminated with a CGL layer or a CTL layer in the same manner as the photoreceptor may be employed. Then, this sheet is wound around a raw aluminum tube and the photosensitive layer is grounded to GND. The resultant body is set to the position of the photosensitive drum and then, toner is developed on the surface of the sheet and adhered thereto.

The photosensitive sheet having the toner adhered thereto is cut into a size of the sample-receiving plate 8 and, by making use of a double-coated tape, is stuck to the side of the sample-receiving plate 8 which is adapted to be contacted with the spacer 7.

The outer diameter of all of the sample mounting plate 6, the sample-receiving plate 8 and the spacer 7 is 7 mm for example, and the thickness and height of the cylindrical spacer are 1 mm and 3 mm, respectively, for example. The minimum rotational diameter (Rmin) of the cell 3 as it is mounted on the angle rotor is 3.56 cm, the maximum rotational diameter (Rmax) thereof is 7.18 cm for example and an average diameter (Rav) thereof is 5.37 cm for example.

The sample container 5 is positioned in the cell 3 in such a manner that the rear side of sample mounting plate 6 where the sample is attached is directed to face the rotational center. The cell 3 is positioned in the cell-holding portion 9 of the angle rotor 10. Then, the angle rotor 10 is mounted on an ultracentrifugal separator (not shown).

The ultracentrifugal separator is rotated at 10000 rpm for example, after which the sample mounting plate 6 and the sample-receiving plate 8 are taken out and the toner adhering to these plates are removed by making use of mending tape and put on a white paper. The concentration of the reflection of the tape having the toner adhered thereto is measured by making use of Macbeth densitometer.

The quantity of toner that has been separated as well as the quantity of toner that has not been separated are respectively calculated from the concentration of the reflection.

Further, the rotational speed of the ultracentrifugal separator is increased stepwise suitably up to 100000 rpm and the same procedures as explained above are repeated.

The centrifugal acceleration (RCF) acting on the sample mounted in the cell by the effect of the rotation of rotor can be expressed as follows:

$$RCF=1.118\times10^{-5}\times r\times N^2\times g \quad (1)$$

r: Distance between the set position of sample and the rotational center

N: Rotational speed (rpm)

g: Gravitational acceleration

The centrifugal force acting on the toner when the weight of a single particle of toner is defined as m can be expressed as follows:

$$F=RCF\times m \quad (2)$$

$$m=(4/3)n\times r^3\times\rho p \quad (3)$$

r: Diameter (assumed as spherical)

ρ: Specific gravity of toner

In this invention, the average adhesive strength between the toner and the photoreceptor is determined from the calculation wherein the centrifugal force acted on the toner at each rotational speed (F=RCF×m . . . (2)) is multiplied by the ratio of the toner that has been separated at each rotational speed and all of the resultant values are added together.

By the way, since the adhesive strength is greatly influenced by the quantity of electrification of toner, it is desirable, in order to accurately measure the adhesive strength, to prepare the measuring samples in such a manner that the toner is adhered according to the actual process.

The developing agent to be employed in the present invention comprises a colorant, and toner particle containing a binder resin, and also, as required, toner including additives to be applied to the surface of the toner particle. In the case of binary developing agent, the toner and carrier are mixed together.

As for the binder resin, it is possible to employ polyester resin, styrene-acrylic resin, etc.

As for the colorant, it is possible to employ known pigments and dyes such as carbon black, condensed polycyclic pigments, azo pigments, phthalocyanine pigments, inorganic pigments, etc.

As for the fixing-assisting agent, it is possible to employ wax, electrification controlling agent (CCA), these fixing-assisting agents being added into the particles of toner. Further, in order to improve the fluidity of toner, inorganic fine particle such as silica may be applied as an additive to the surface of the particles of toner.

The particles of toner can be manufactured by known manufacturing method such as grinding, polymerization, etc.

In order to satisfy the regulation of the distribution of adhesive strength, the developing agent to be employed in the present invention should preferably be adjusted so as to make the distribution of particle size sharp by eliminating fine particles and coarse particles.

It is preferable to confine the volume average particle diameter of developing agent to the range of 4 to 7 μm.

It is also preferable to classify toner particle so as to eliminate those having a particle diameter of not more than 2 μm and those having a particle diameter of not less than 10 μm. In order to make the surface components of particle uniform, the conditions in the manufacture of toner by means of grinding should preferably be controlled so as to prevent the generation of non-uniformity in temperature and in stress of kneading apparatus. Further, in order to prevent non-uniformity of components in the developing agent, the quantity of component to be loaded as well as the timing of loading should be controlled. Further, in order to prevent the non-uniformity in deposition of additives on toner particle, it is preferable to calculate the loading quantity of additives on the basis of the particle diameter of additives and the particle diameter of toner so as to enable one or two layers of additives to be formed on the surface of toner, thereby making it possible to uniformly deposit the additives on the surface of toner.

Further, in order to make the distribution in electrification of toner uniform, it is preferable, in the case of binary developing agent, to mix the toner with a suitable quantity of carrier particle, and it is also preferable, in the case of one-component developing agent, to suitably set the contacting pressure and configuration between the electrificating member and developing agent in the developing portion.

In the case of binary (two-component) development, the carrier to be employed therein may be formed of a magnetic carrier such as resin particle containing therein ferrite, magnetite, iron oxide or magnetic powder, wherein the surface of carrier may be entirely or partially coated with resin.

FIGS. 4, 5, 6 and 7 illustrate respectively one example of image forming apparatus according to the present invention.

Figure 4:
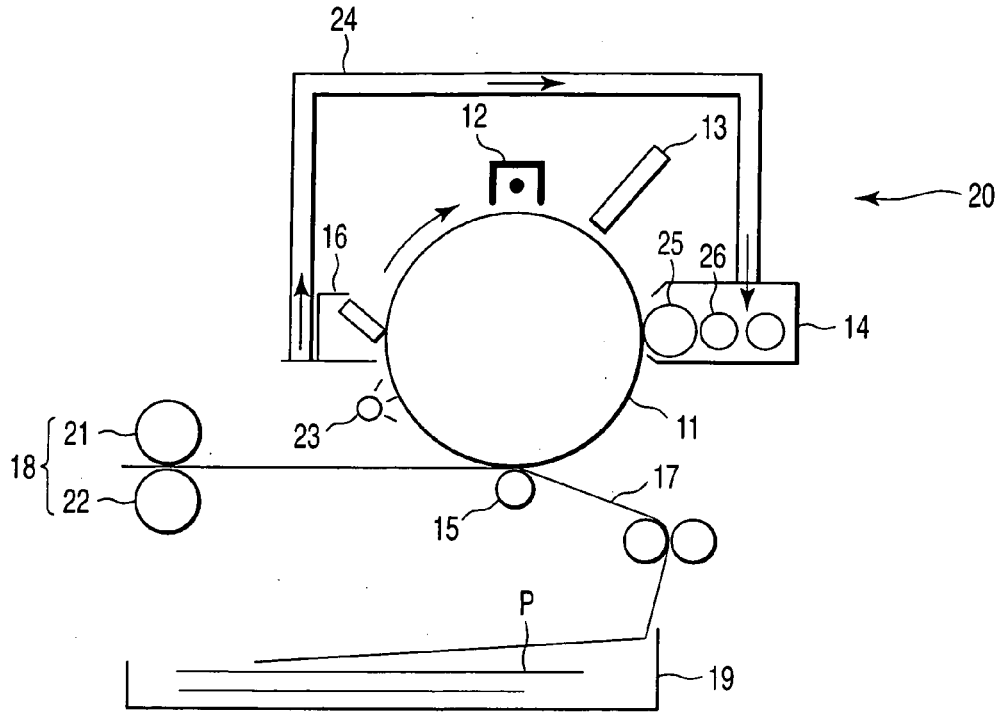
FIG. 4 is a diagram schematically illustrating one example of the image forming apparatus according to the present invention.

As shown in FIG. 4, the image forming apparatus 20 comprises an image forming unit which is constituted by a photoreceptor 11, around which an electrificating device 12, an exposure portion 13, a developing device 14, a transferring portion 15 and a cleaning device 16 are successively disposed so as to face the photoreceptor 11.

The transferring portion 15 is disposed so as to face the photoreceptor 11 being interposed therebetween. At the downstream side of the delivery member 17 is disposed a fixing portion 18. A delivery passageway 24 is provide between the cleaning device 16 and the developing device 14, thereby constructing a recycle mechanism for recovering residual toner.

In this image forming apparatus 20, the photoreceptor 11 is made rotatable in the direction indicated by arrow "a" and is uniformly impressed by a surface potential of −500~800V by means of the charging device 12 such as a charger wire, a tandem type charger, a corona charger, a contact type charging roller, a non-contact type charging rotor, a solid charger, etc. By means of the exposure portion 13, an electrostatic image is formed on the photoreceptor 11. As for the exposure portion, a light source such as laser, LED, etc. may be employed. By the way, as for the photoreceptor 11, it is possible to employ a plus-charged or minus-charged organic photosensitive layer, an amorphous silicon layer, etc. The photosensitive layer to be formed on the surface of photoreceptor may be further laminated with an electric charge-generating layer, an electric charge-transfer layer and a protective layer. Alternatively, a single photosensitive layer may be constructed so as to exhibit a plurality of functions. The developing device 14 comprises a developing roller 25 having a magnet roller built therein for example and is constructed to feed a negatively charged toner for example to an electrostatic image to develop an image by way of a magnetic brush development which is designed to deliver a binary developing agent. For the purpose of forming an electric field for enabling the toner to adhere onto the electrostatic image, a developing bias is applied to the developing roller 25. Further, in order to enable the toner to uniformly and stably adhere on the surface of photoreceptor, the developing bias may be composed such that DC is superimposed by AC. The developing agent to be employed herein comprises a colorant, and a toner containing a binder resin. This developing agent is formulated such that, in the number particle size distribution of toner, the ratio of the toner having a particle diameter of not more than A×0.5 (μm) (wherein A is a 50% average particle diameter (μm)) and the ratio of the toner having a particle diameter of not less than A×1.5 (μm) (wherein A is a 50% average particle diameter (μm)) are both confined to not more than 5% by number; and that, in a distribution of adhesive strength to the surface of the image carrier, the ratio of the toner having an adhesive strength of not more than $1.3\times10^{-8}$(N) is confined to 10% by weight or less and the ratio of the toner having an adhesive strength of not less than $3\times10^{-7}$(N) is confined to 5% by weight or less.

In the developing device 14, for example, 100 g~700 g of a binary developing agent consisting of carrier and toner are placed in the toner hopper thereof and the developing agent is delivered to the developing roller 25 by means of agitation auger 26. After part of the toner is consumed due to the development, the residual toner is permitted to leave from the developing roller 25 at the separating position of the developing roller 25 and returned to the developing agent storage region by means of the agitation auger 26. A toner concentration sensor (not shown) is attached in the developing agent storage region, so that when any decrease in quantity of developing agent is detected by this concentration sensor, the signal thereof is transmitted to the toner hopper. As a result, fresh toner is replenished. The quantity of consumption of toner can be estimated from the integration of printing data and/or from detection of the quantity of developing toner on the photoreceptor. The replenishment of fresh toner may be performed on the basis of the aforementioned estimation. It is also possible to utilize both of these means, i.e. the output of sensor and the estimation of the quantity of consumption of toner.

At the downstream side of the developing device 14, the transfer roller 15 is press-contacted with the photoreceptor 11 and a recording medium such as paper P which has been fed from the paper supply portion 19 is interposed between the transfer roller 15 and the photoreceptor 11. Further, by the effect of a bias voltage of +300 V to 5 kV for example which has been applied to the transfer roller 15 from a high-voltage power source (not shown), the toner image on the photoreceptor 11 is transferred to the paper. The paper P that has passed through a transcription nip is then moved to the fixing device 18.

The fixing device 18 comprises a couple of rollers consisting of a press roller 22 and a heat roller 21. The paper P is passed through an interface between the press roller 22 and the heat roller 21 under the condition where the toner image is contacted with the heat roller 21, thereby fixing the toner image on the paper P.

After finishing the transfer of toner image, the residual toner is removed by means of the cleaning device 16 at the downstream region of the transcription nip and destaticized by making use of destaticizing means 23. The residual toner removed by the cleaning device 16 is delivered by means of auger (not shown) into the delivering passageway 24 and recovered in the developing device 14.

By the way, when one-component development system is to be employed, only toner is stored in the developing agent storage region and then delivered to the surface of developing roller by means of known member such as a delivering auger, an intermediate delivery sponge roller, etc. Then, by means of a toner charging member such as a silicone rubber blade, a fluorine-containing rubber blade, a metal blade, etc. which is press-contacted with the surface of developing roller, the toner is frictionally charged, thus developing an electrostatic latent image. The developing roller is formed of an elastic roller having a conductive rubber layer on the surface thereof or formed of a metallic roller made of SUS and having a roughened surface which is effected by making use of sand blast. Further, this developing roller is disposed in contact with the photoreceptor or in non-contact with the photoreceptor with a predetermined gap being interposed therebetween and is enabled to rotate at a rotational speed which differs from that of the surface of the photoreceptor. In order to assist the adhesion of toner onto the electrostatic latent image, a developing bias is applied to the developing roller. Further, in order to enable the toner to uniformly and stably adhere on the surface of photoreceptor, the developing bias may be composed such that DC is superimposed by AC.

This developing agent is formulated such that, in the number particle size distribution of toner, the ratio of the toner having a particle diameter of not more than A×0.5 (μm) (wherein A is a 50% average particle diameter (μm)) and the ratio of the toner having a particle diameter of not less than A×1.5 (μm) (wherein A is a 50% average particle diameter (μm)) are both confined to not more than 5% by number; and that, in a distribution of adhesive strength to the surface of the image carrier, the ratio of the toner having an adhesive strength of not more than $1.3\times10^{-8}$(N) is confined to 10% by weight or less and the ratio of the toner having an adhesive strength of not less than $3\times10^{-7}$(N) is confined to 5% by weight or less.

Figure 5:
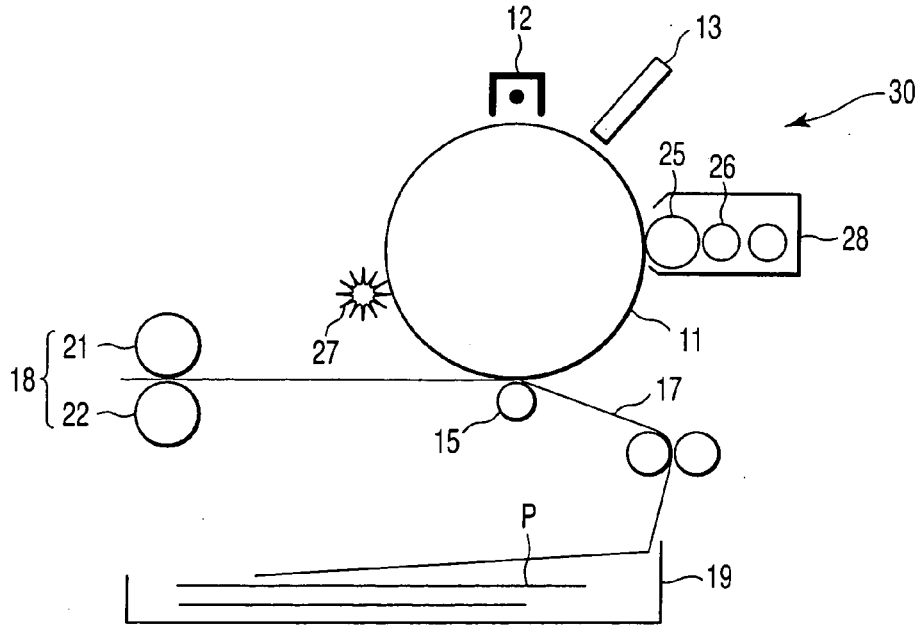
FIG. 5 is a diagram schematically illustrating another example of the image forming apparatus according to the present invention.

FIG. 5 shows a diagram schematically illustrating another example of the image forming apparatus according to the present invention. The image forming unit of this image forming apparatus is fundamentally the same as that shown in FIG. 4 except that the cleaning device 16 and the delivery passageway 24 are not provided, a developing device 28 having a development/cleaning mechanism is substituted for the developing device 14, and a memory disturbing member 27 is interposed between the transferring portion 15 and the charging device 12. The developing agent to be employed herein is formulated such that, in a number particle size distribution of toner, the ratio of the toner having a particle diameter of not more than A×0.5 (μm) (wherein A is a 50% average particle diameter (μm)) and the ratio of the toner having a particle diameter of not less than A×1.5 (μm) (wherein A is a 50% average particle diameter (μm)) are both confined to not more than 4% by number; and that, in a distribution of adhesive strength to the surface of the photoreceptor 11, the ratio of the toner having an adhesive strength of not less than $3\times10^{-7}$(N) is confined to 4% by weight or less.

By the way, it is also possible to dispose a temporary recovering member (not shown) so as to make it possible to temporarily recover the residual toner in the developing device and to deliver it again to the image carrier. In order to enable the memory disturbing member and the temporary recovering member to function efficiently, a plus and/or a minus voltage may be applied thereto.

Further, in place of the aforementioned developing agent, it is also possible to employ a developing agent which is formulated such that, in a number particle size distribution of toner, the ratio of the toner having a particle diameter of not more than A×0.5 (μm) (wherein A is a 50% average particle diameter (μm)) and the ratio of the toner having a particle diameter of not less than A×1.5 (μm) (wherein A is a 50% average particle diameter (μm)) are both confined to not more than 4% by number; and that, in a distribution of adhesive strength to the surface of the photoreceptor 11, the ratio of the toner having an adhesive strength of not less than $3\times10^{-7}$(N) is confined to 4% by weight or less and the ratio of the toner having an adhesive strength of not more than $1.3\times10^{-8}$(N) is confined to 10% by weight or less.

Figure 6:
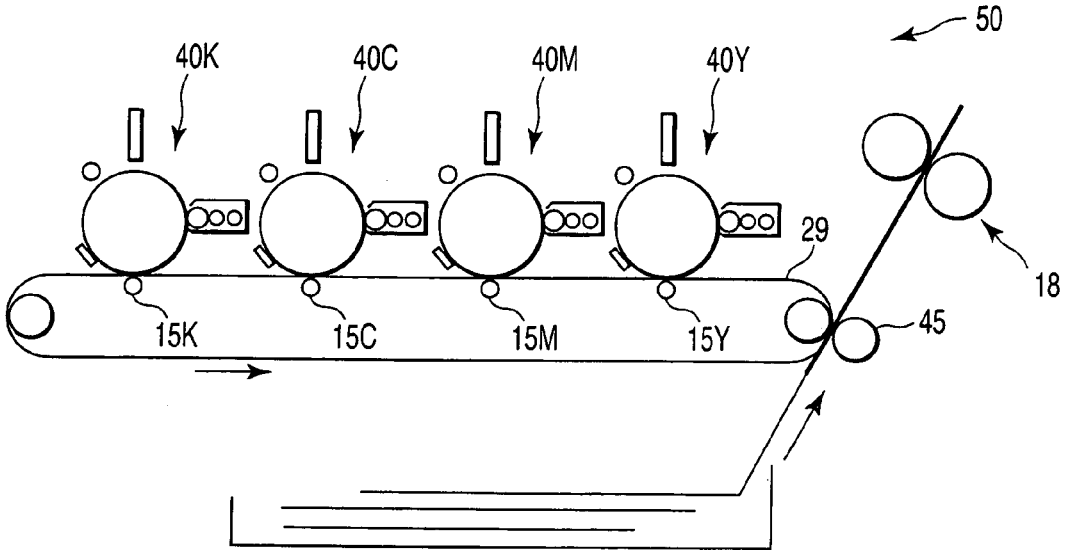
FIG. 6 is a diagram schematically illustrating another example of the image forming apparatus according to the present invention.

FIG. 6 shows a diagram schematically illustrating one example of the color image forming apparatus according to the present invention.

This color image forming apparatus 50 is constructed in the same manner as the imaging unit shown in FIG. 4, wherein image forming units 40Y, 40M, 40C and 40K accommodating therein a yellow color developing agent, a Magenta color developing agent, a cyan color developing agent and a black color developing agent, respectively, are arranged in four stages so as to enable these units to face the transferring regions 15Y, 15M, 15C and 15K, respectively, through an intermediate transferring member 29, and a secondary transferring portion 45 and a fixing region 18 are disposed on the downstream side of the transferring region 15K. The developing agent is formulated such that, in a number particle size distribution of toner, the ratio of the toner having a particle diameter of not more than A×0.5 (μm) (wherein A is a 50% average particle diameter (μm)) is confined to not more than 3% by number; and that, in a distribution of adhesive strength to the surface of the intermediate transferring member 29 of toner, the ratio of the toner having an adhesive strength of not more than $1.3\times10^{-8}$ (N) is confined to 5% by weight or less.

Further, in place of the imaging unit shown in FIG. 4, the imaging unit shown in FIG. 5 can be employed as the image forming units 40Y, 40M, 40C and 40K. In this case, the developing agent to be employed is formulated such that, in a number particle size distribution of toner, the ratio of the toner having a particle diameter of not more than A×0.5 (μm) (wherein A is a 50% average particle diameter (μm)) is confined to not more than 2% by number; and that, in a distribution of adhesive strength to the surface of the intermediate transferring member 29 of toner, the ratio of the toner having an adhesive strength of not more than $1.3\times10^{-8}$(N) is confined to 3% by weight or less.

Figure 7:
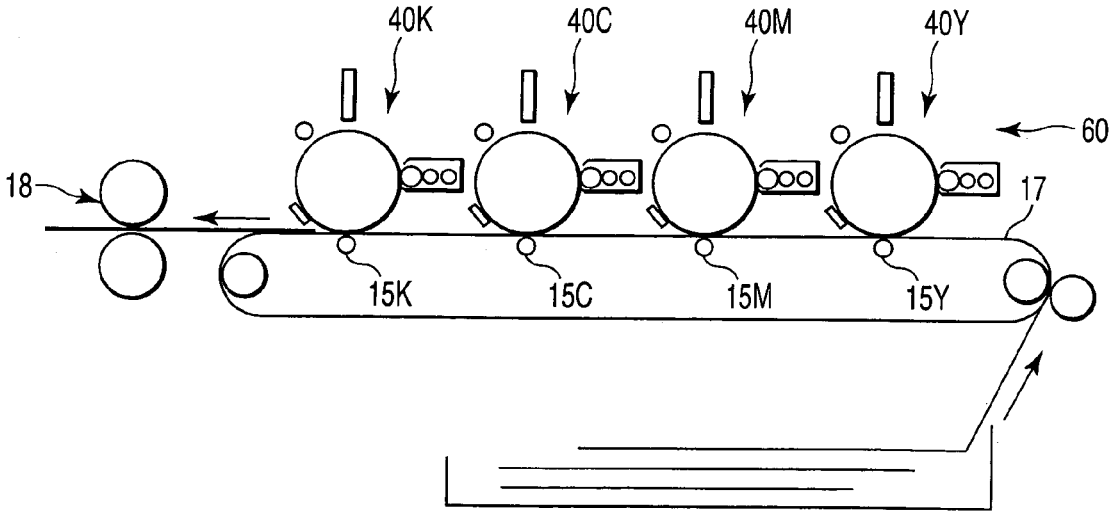
FIG. 7 is a diagram schematically illustrating another example of the image forming apparatus according to the present invention.

FIG. 7 shows a diagram schematically illustrating another example of the color image forming apparatus according to the present invention.

This color image forming apparatus 60 is constructed in the same manner as the imaging unit shown in FIG. 4, wherein image forming units 40Y, 40M, 40C and 40K accommodating therein a yellow color developing agent, a Magenta color developing agent, a cyan color developing agent and a black color developing agent, respectively, are arranged in four stages so as to enable these units to face the transferring regions 15Y, 15M, 15C and 15K, respectively, through a transferring member 17, and a fixing region 18 is disposed on the downstream side of the transferring region 15K. This apparatus is constructed in the same manner as the apparatus shown in FIG. 6 except that a delivery member 17 is substituted for the intermediate transferring member 29 and that the intermediate transferring member 29 and the secondary transferring portion 45 are not employed. In this case, the transcription is performed directly on a transferring medium such as paper at each of the transferring regions 15Y, 15M, 15C and 15K.

Further, in place of the imaging unit shown in FIG. 4, the imaging unit shown in FIG. 5 can be employed as the image forming units 40Y, 40M, 40C and 40K.

Next, the present invention will be more specifically explained with reference to experimental examples.

EXPERIMENTAL EXAMPLES

Four kinds of toners and two kinds of carriers were prepared as follows.

Preparation of Toner A:

92 parts by weight of polyester resin, 6 parts by weight of Carmine 6B, and 2 parts by weight of rice wax were mixed and kneaded together. After being subjected to coarse crushing and fine grinding, the resultant mixture was subjected to elbow jet classification to remove the particles having a particle diameter of 8 μm or more and having a particle diameter of 3 μm or less and further subjected to suffusing treatment to thereby apply mechanical globularization treatment to the particles, thus obtaining toner particle having a sphericity of 0.95.

To 96 parts by weight of the toner particle thus obtained, 3 parts by weight of silica having a primary particle diameter of 70 nm and one part by weight of titanium oxide were added as an additive by making use of Henschel mixer to obtain Toner A having a 50% average particle diameter of 4.6 μm and a particle size distribution wherein the ratio of toner having a particle diameter of 2.3 μm or less was 2% and the ratio of toner having a particle diameter of 6.9 μm or more was 4.2%.

When the toner was subjected to quantitative analysis and visual observation, the surface of toner particle was assumed as being substantially uniformly covered by a single layer of additives.

Preparation of Carrier α:

To spherical ferrite core having a volume average particle diameter of 40 μm, silicon resin coat was applied to obtain Carrier α having a surface resistance of: $1\times10^{9}$ Ω/cm$^2$.

Preparation of Toner B:

By repeating the same procedures as employed in the manufacture of Toner A excepting that the mixing ratio of rice wax was changed to 2 parts by weight, Toner B was obtained, Toner B having a 50% average particle diameter of 4.5 μm and a particle size distribution wherein the ratio of toner having a particle diameter of 6.75 μm or more was 5% and the ratio of toner having a particle diameter of 2.25 μm or less was 2.8%.

Preparation of Toner C:

Toner A was subjected to a stronger suffusing treatment than that employed in the preparation of Toner A to thereby apply mechanical globularization treatment to Toner A, thus obtaining toner particle having a sphericity of 0.97. Then, to 96.5 parts by weight of the toner particle thus obtained, 2.5 parts by weight of silica having a primary particle diameter of 70 nm and one part by weight of titanium oxide were added as an additive by making use of Henschel mixer to obtain Toner C.

Preparation of Carrier β:

To spherical ferrite core having an average particle diameter of 40 μm, silicone resin coat was applied to obtain Carrier β having a surface resistance of: $11.5\times10^{10}$ Ω/cm$^2$ which is higher than that of Carrier α.

Preparation of Carrier γ:

A core made of spherical magnetite and having a surface resistance of: $5\times10^{6}$ Ω/cm$^2$ was coated with fluororesin having conductive particle made of carbon black dispersed therein to an average thickness of about 5 μm to obtain semiconductive Carrier γhaving a volume average particle diameter of 35 μm.

Preparation of Toner D:

A mixture comprising 60 parts by weight of styrene monomer, 30 parts by weight of acrylic monomer, 2 parts by weight of rice wax, 7 parts by weight of Carmine 6B, and one part by weight of CCA was subjected to emulsion polymerization to manufacture polymer particle having a diameter of 0.1 μm. Then, the polymer particle was subjected to aggregation, washing and drying to obtain toner particle having an average particle diameter of 4.9 μm. The sphericity of the toner particle thus obtained was 0.96. To 92 parts by weight of this toner particle, 6 parts by weight of silica having a primary particle diameter of 20 nm and 2 parts by weight of titanium oxide were added thereto as an additive to obtain Toner D.

Preparation of Toner E:

Toner E was obtained by repeating the same procedures as employed in the manufacture of Toner D excepting that the mixing ratio of silica having a primary particle diameter of 35 nm was changed to 8 parts by weight.

Experiment 1

5 parts by weight of Toner B was mixed with 95 parts by weight of Carrier a to obtain a developing agent.

The developing agent thus obtained was applied to an image forming apparatus having the same structure as shown in FIG. 5 except that a film having the same photosensitive layer as the photoreceptor was wound around the surface of photoreceptor, thereby performing electrification, exposure and development of toner.

The film where the Toner B was developed was taken out as it is and the distribution of adhesive strength of toner was measured. The results are shown in FIG. 8.

Figure 8:
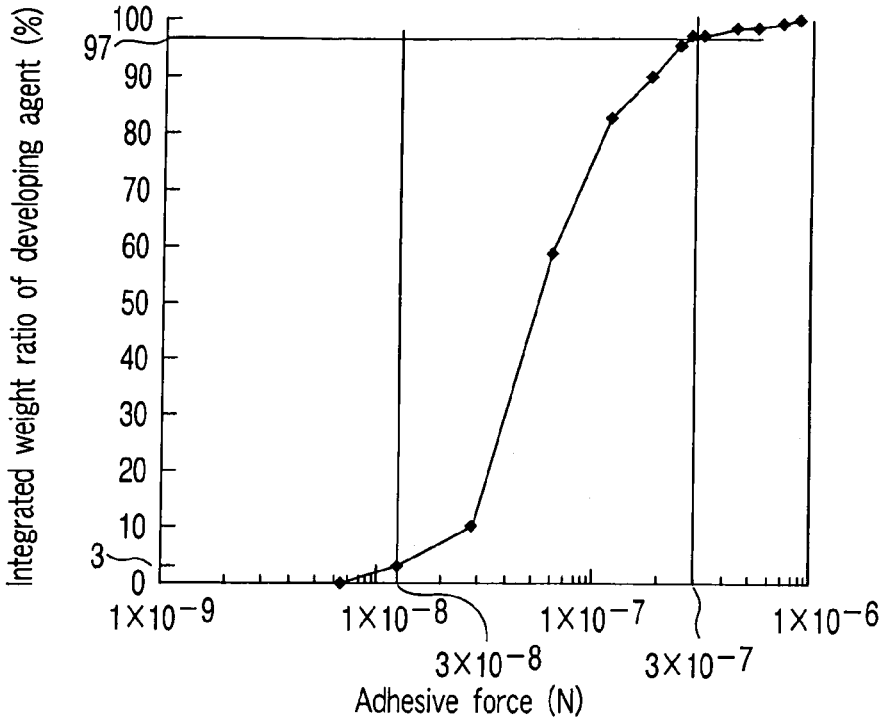
FIG. 8 is a graph illustrating one example of a first distribution of adhesive strength to be employed in the formation of an image according to the present invention.

FIG. 8 shows a graph illustrating one example of the distribution of adhesive strength employed in the formation of image according to the first condition to be employed in the present invention.

This graph illustrates the relationship between the adhesive strength of the developing agent and the added weight ratio of the developing agent having the aforementioned adhesive strength.

As shown in FIG. 8, the ratio of particle having an adhesive strength of $1.3\times10^{-8}$(N) or less and the ratio of particle having an adhesive strength of $3.0\times10^{-7}$(N) or more were both 3% by weight.

Further, there was prepared an image forming apparatus having the same structure as that of FIG. 4 except that an intermediate transferring body was substituted for the delivering member and that the recording medium was not fed thereto. The aforementioned developing agent was applied to this image forming apparatus to permit the developing agent to be transferred to the intermediate transferring body. The transferring properties of toner were measured in such a manner that the residual toner was peeled away by making use of tape and the concentration of reflection of the toner was measured by making use of Macbeth densitometer and the measured result was applied to the calibration formula related to the concentration and quantity of toner, thereby determining the transferring properties of toner.

When a life test was performed using these apparatus and developing agent, the fluctuation in quantity of electrification of toner was confined within a permissible range even if the printing was repeated up to 100K, thus not indicating any inconvenience in the recycling of toner.

Likewise, the aforementioned toners A, B, C, D and E were variously combined with the aforementioned carriers α, β and γ as shown in the following Table 1 to measure the number particle size distribution, the distribution of adhesive strength, the quantity of residual toner, and the magnitude of reverse transcription, thereby assaying the degree of dust and the defects of fine line.

TABLE 1

| | Samples of developing agent | | |
|---|---|---|---|
| | Toner | Carrier | T/D (%) |
| Sample 1 | A | α | 5 |
| Sample 2 | A | α | 9 |
| Sample 3 | B | α | 5 |
| Sample 4 | C | α | 5 |
| Sample 5 | C | α | 9.5 |
| Sample 6 | B | β | 7 |
| Sample 7 | B | γ | 7 |
| Sample 8 | D | γ | 11 |
| Sample 9 | E | γ | 11 |

By the way, the defects of fine line was assayed by measuring the concentration of image in the longitudinal direction of fine line to determine the scattering in concentration of fine line. The scattering in concentration of fine line was determined as follows.

Scattering of fine line=Standard deviation of concentration of fine line/average value of concentration of fine line The results thus obtained are shown the following Tables 2 and 3.

TABLE 2

| | | Particle size distribution | | Adhesive strength distribution | | |
|---|---|---|---|---|---|---|
| | Number distribution D50 (μm) | D50 × 1.5 (μm) or more (%) | D50 × 0.5 (μm) or less (%) | $3.0\times10^{-7}$N or more (%) (To photoreceptor) | $1.3\times10^{-8}$N or less (%) (To photoreceptor) | $1.3\times10^{-8}$N or less (%) (To intermediate transfer body) |
| Sample 1 | 4.6 | 4.2 | 2 | 5.5 | 9 | 7 |
| Sample 2 | 4.6 | 4.2 | 2 | 1 | 26 | 12 |
| Sample 3 | 4.5 | 5 | 2.8 | 3 | 4 | 3.5 |
| Sample 4 | 4.7 | 3.8 | 1.7 | 2.8 | 3 | 2.8 |
| Sample 5 | 4.7 | 3.8 | 1.7 | 1 | 17 | 9.5 |
| Sample 6 | 4.55 | 5.3 | 7 | 3.2 | 5 | 4.5 |
| Sample 7 | 4.3 | 2 | 5 | 4.2 | 3.5 | 3 |
| Sample 8 | 4.9 | 3.9 | 1.2 | 0.5 | 1.8 | 1.2 |
| Sample 9 | 4.8 | 3 | 1.3 | 1.5 | 2 | 1.5 |

TABLE 3

| | Residual toner (wt %) | Reversely transferred toner (wt %) | Degree of dust | Defects of fine line |
|---|---|---|---|---|
| Sample 1 | 4.3 | 4.5 | 1.5 | 0.095 |
| Sample 2 | 2.8 | 6.3 | 1.9 | 0.11 |
| Sample 3 | 3 | 3 | 1.3 | 0.07 |
| Sample 4 | 2.4 | 2 | 1.26 | 0.06 |
| Sample 5 | 1.9 | 4.9 | 1.6 | 0.09 |
| Sample 6 | 3.8 | 3.5 | 1.7 | 0.08 |
| Sample 7 | 2.2 | 4 | 1.45 | 0.075 |
| Sample 8 | 1 | 1.4 | 1.2 | 0.05 |
| Sample 9 | 1.5 | 1.5 | 1.23 | 0.055 |

As shown in Table 2, the samples 3, 4, 7, 8 and 9 all meet the aforementioned first condition to be employed in the present invention. In the number particle size distribution of toner, the ratio of the particles of developing agent having a particle diameter of not more than A×0.5 (μm) (wherein A is a 50% average particle diameter (μm)) and the ratio of the particles of developing agent having a particle diameter of not less than A×1.5 (μm) (wherein A is a 50% average particle diameter (μm)) were both confined to not more than 5% by number; and in a distribution of adhesive strength to the surface of the image carrier, the ratio of the developing agent having an adhesive strength of not more than $1.3\times10^{-8}$ (N) was confined to 10% by weight or less and the ratio of the developing agent having an adhesive strength of not less than $3\times10^{-7}$(N) was confined to 5% by weight or less.

The samples 3, 4, 7, 8 and 9 all satisfying the aforementioned first condition were all excellent in the quantity of residual toner, the quantity of reversely transferred toner, the degree of dust, and the defects of fine line.

In the case of the sample 1, the ratio of the toner having an adhesive strength of not less than $3\times10^{-7}$(N) was more than 5% by weight in a distribution of adhesive strength of toner to the surface of the photoreceptor. In the cases of the sample 2 and 5, the ratio of the toner having an adhesive strength of not more than $1.3\times10^{-8}$(N) was more than 10% by weight in a distribution of adhesive strength of toner to the surface of the photoreceptor. In the case of the sample 6, the ratio of the toner having a particle diameter of not less than 1.5 times as high as the 50% average particle diameter and the ratio of the toner having a particle diameter of not more than 0.5 time as high as the 50% average particle diameter were both more than 5% by number. Therefore, these samples are comparative examples against the aforementioned first condition.

As shown in Table 3, in the cases of the samples of 1 and 2, the quantity of residual toner and the quantity of reversely transferred toner were considerably large, and the degree of dust was badly increased to 1.5 or more. Further, the defects of fine line were also prominent.

In the case of the sample 5, the quantity of reversely transferred toner was considerably large, and the degree of dust was badly increased to 1.5 or more. Further, the defects of fine line were also prominent.

In the case of the sample 6, the quantity of residual toner and the quantity of reversely transferred toner were considerably large, and the degree of dust was badly increased to 1.5 or more. Further, the defects of fine line were also prominent.

Figure 9:
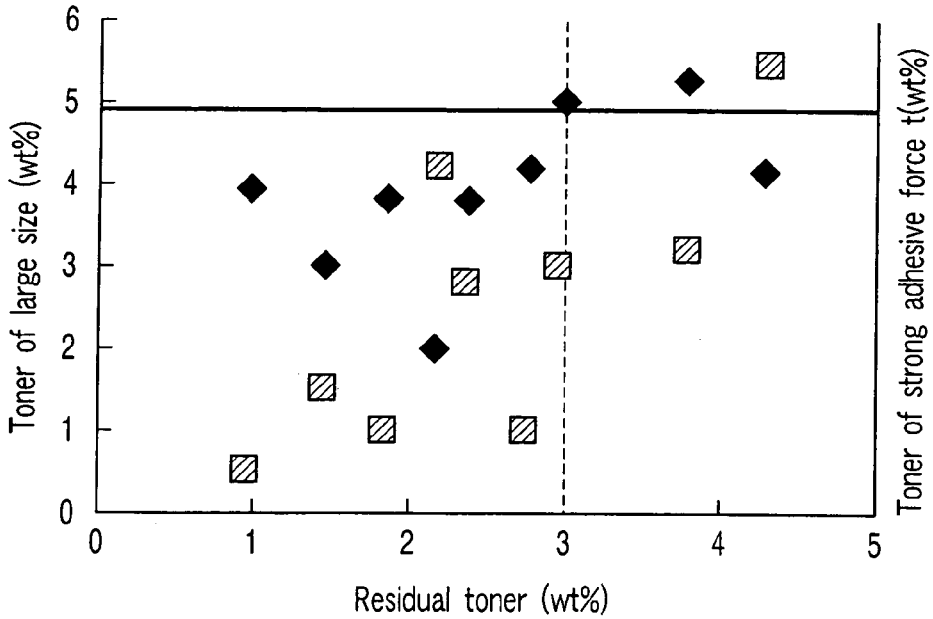
FIG. 9 is a graph illustrating the relationship between the quantity of toner of large particle size and the quantity of residual toner as well as the relationship between the quantity of toner having a strong adhesive strength and the quantity of residual toner.

FIG. 9 shows a graph illustrating the relationship between the quantity of toner of large particle size, i.e. not less than 1.5 times as large as the 50% average particle diameter, and the quantity of residual toner as well as the relationship between the quantity of toner having a strong adhesive strength, i.e. not less than $3.0\times10^{-7}$(N), and the quantity of residual toner.

The plotted points which are the same in residual toner indicate the data of the same sample. In FIG. 9, the symbol ♦ indicates the quantity of toner of large size and the symbol ■ indicates the quantity of toner having a strong adhesive strength. As shown in FIG. 9, when the quantities of toner of large size and toner having a strong adhesive strength are both confined to not more than 5% by weight, it was possible to suppress the quantity of residual toner to 3% by weight or less.

Figure 10:
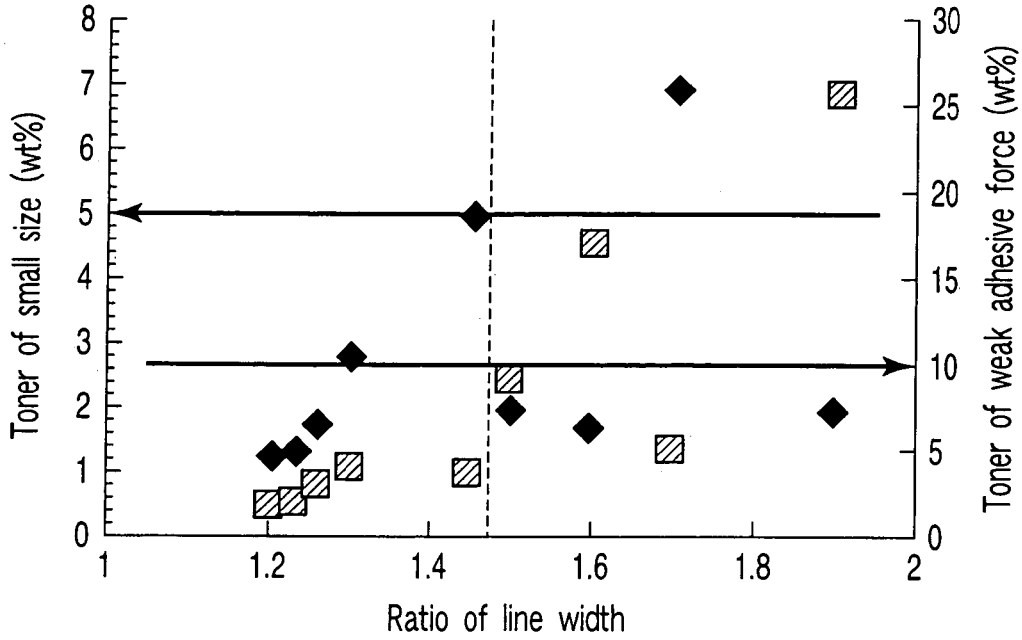
FIG. 10 is a graph illustrating the relationship between the quantity of toner of small particle size and the ratio of the width of fine line on a transferring medium to the width of fine line on the photoreceptor (the degree of dust) as well as the relationship between the quantity of toner having a weak adhesive strength and the ratio of the width of fine line on a transferring medium to the width of fine line on the photoreceptor (the degree of dust)

FIG. 10 shows a graph illustrating the relationship between the quantity of toner of small particle size, i.e. not more than 0.5 time as large as the 50% average particle diameter, and the ratio of the width of fine line on a transferring medium to the width of fine line on the photoreceptor (the degree of dust) as well as the relationship between the quantity of toner having a weak adhesive strength, i.e. not more than $1.3\times10^{-8}$(N), and the ratio of the width of fine line on a transferring medium to the width of fine line on the photoreceptor (the degree of dust).

In FIG. 10, the symbol ♦ indicates the quantity of toner of small size and the symbol ■ indicates the quantity of toner having a weak adhesive strength. The plotted points which are the same in degree of dust indicate the data of the same sample.

The ratio of the width of fine line represents the deterioration of image on the occasion of transcription. Herein, when the degree of dust was 1.5 or less, it was assumed as falling within a permissible range.

When the quantity of toner of small size was confined to 5% by weight or less and the quantity of toner having a weak adhesive strength was confined to not more than 10% by weight, it was possible to suppress the degree of dust to 1.5 or less.

When a life test was performed using these developing agents, the degree of trouble such as the fluctuation in quantity of electrification of toner was confined within a permissible range even if the printing was repeated up to 100K in the cases of samples where the quantity of residual toner was confined within the range of 5% by weight or less. On the other hand, in the cases of samples where the quantity of residual toner was larger than 5% by weight, the magnitude of electrification of toner was gradually increased, indicating decreases in concentration of image.

Experiment 2

The toners shown in above Table 1 were applied to an image forming apparatus having the same structure as shown in FIG. 5 to measure the quantity of residual toner.

Figure 11:
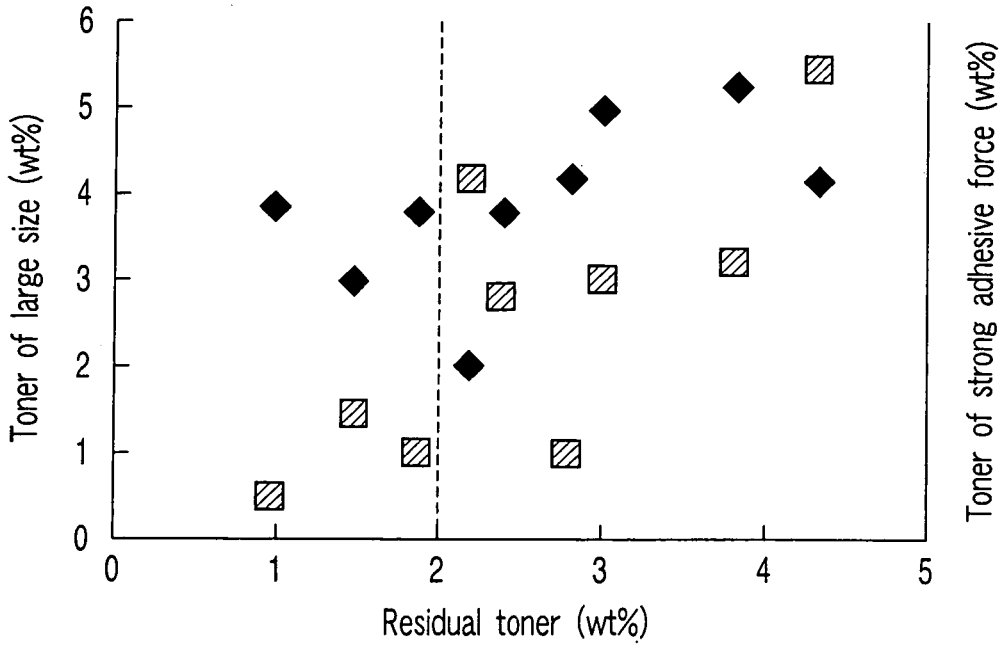
FIG. 11 is a graph illustrating the relationship between the quantity of toner of large particle size and the quantity of residual toner as well as the relationship between the quantity of toner having a strong adhesive strength and the quantity of residual toner.

FIG. 11 shows a graph illustrating the relationship between the quantity of toner of large particle size, i.e. not less than 1.5 times as large as the 50% average particle diameter, and the quantity of residual toner as well as the relationship between the quantity of toner having a strong adhesive strength, i.e. not less than $3.0\times10^{-7}$(N), and the quantity of residual toner.

The plotted points which are the same in residual toner indicate the data of the same sample. In FIG. 11, the symbol ♦ indicates the quantity of toner of large size and the symbol ■ indicates the quantity of toner having a strong adhesive strength.

It was found from FIG. 11 that when the quantity of toner having a particle size of not less than 1.5 times as large as the 50% average particle diameter and the quantity of toner having an adhesive strength of not less than $3.0\times10^{-7}$(N) were both confined to not more than 4% by weight, it was possible to suppress the quantity of residual toner to 2% by weight or less.

When a developing agent containing not more than 2% by weight of residual toner was employed, it was possible to prevent the generation of inconveniences such as negative memory due to exposure obstruction or positive memory due to failure of recovery. When the life test was performed, the generation of memory image was not recognized even if the printing was repeated up to 100K.

As a comparative example, the development of image was performed using the same apparatus and a developing agent containing 3.0% by weight of residual toner.

As a result, since the exposure of image was obstructed by the residual toner, the electric potential of the image portion could not be sufficiently lowered, thus generating a negative memory. Further, when the life test was performed using this apparatus, the efficiency of recovering the residual toner was deteriorated concurrent with the surface deterioration of photoreceptor, it was impossible to recover the residual toner as the printing was repeated 80K, thereby generating a positive memory where the residual toner was transferred to the next image. Even in the cases of other developing agents where the quantity of residual toner exceeds over 2% by weight, negative memory was caused to generate slightly at the initial stage and a positive memory was caused to generate at 90K.

Figure 12:
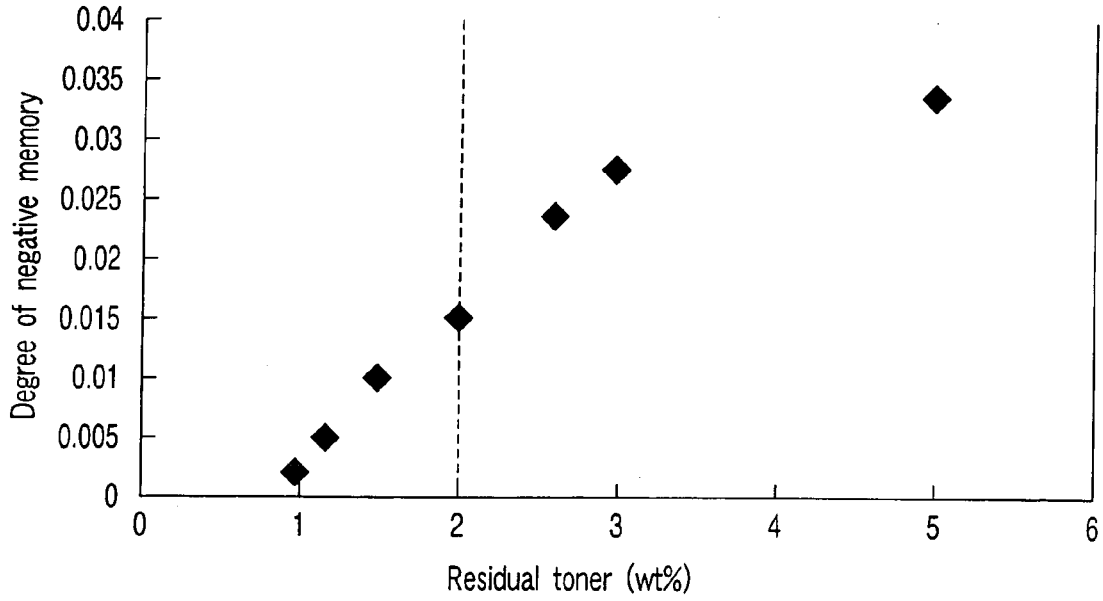
FIG. 12 is a graph illustrating the relationship between the quantity of residual toner and the degree of negative memory.

FIG. 12 shows a graph illustrating the relationship between the quantity of residual toner and the degree of negative memory.

The negative memory was assayed as follows. Namely, the portion which is free from exposure obstruction by the residual toner and the region where the exposure thereof was obstructed due to the residual toner were subjected to development, transcription and fixing to obtain images which were then measured with respect to the concentration of images by making use of a densitometer RD-918 (Macbeth Co., Ltd.), thereby measuring a difference in concentration of images, based on which the negative memory was assayed.

When the difference in concentration of images was confined to not more than 0.015, it was impossible to visually recognize the difference. Therefore, it was found preferable that the quantity of residual toner should be confined to not more than 2% by weight.

Experiment 3

The same kind of apparatus as the image forming apparatus used in Experiment 1 except that an intermediate transferring body was employed in place of the delivering member was prepared.

The surface resistance of the intermediate transferring body may be confined within the range of $10^7$ Ωcm–$10^{12}$ Ωcm (herein $10^9$ Ωcm).

As for the materials to be employed for the intermediate transferring body, they include rubber such as EPDM, CR rubber, etc.; and resin such as polyimide, polycarbonate, PVDF, ETFE, etc. In this case, polyimide resin film was employed as this intermediate transferring body. By making use of developing agents shown in Table 1, the developing agents were developed on a photoreceptor to obtain an image of toner, which was then transferred to this intermediate transferring body under the transferring conditions which enabled to achieve a transfer efficiency of 97% or more. The image of toner transferred onto this intermediate transferring body was taken up the image forming apparatus together with this intermediate transferring body to measure the distribution of adhesive strength.

Figure 13:
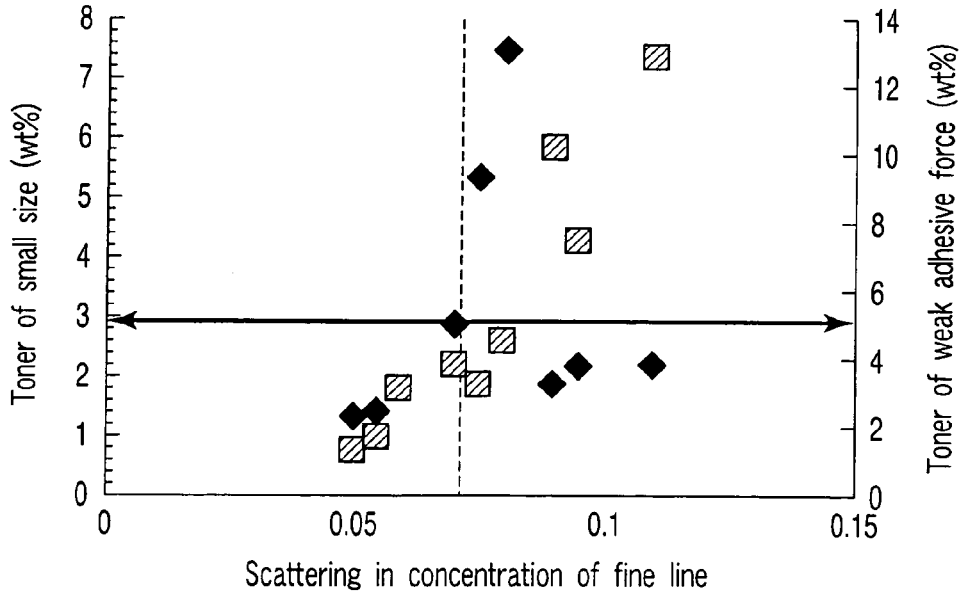
FIG. 13 is a graph illustrating the relationship between the quantity of toner of small particle size and the degree of scattering in concentration of fine line as well as the relationship between the quantity of toner having a weak adhesive strength to an intermediate transferring body and the degree of scattering in concentration of fine line.

FIG. 13 shows a graph illustrating the relationship between the quantity of toner of small particle size, i.e. not more than 0.5 time as large as the 50% average particle diameter and the degree of scattering in concentration of fine line in the longitudinal direction thereof as well as the relationship between the quantity of toner having a weak adhesive strength, i.e. not more than $1.3\times10^{-8}$(N) and the degree of scattering in concentration of fine line in the longitudinal direction thereof.

As shown in FIG. 13, it was found that when the quantity of toner of small particle size was confined to 3% by weight or less and the quantity of toner having a weak adhesive strength was confined to 5% by weight or less, it was possible to confine the scattering in concentration of fine line to not more than 0.07 which was hardly visible, thus indicating decrease of reverse transcription.

Experiment 4

First of all, the same kind of image forming apparatus as shown in FIG. 6 where the imaging unit shown in FIG. 5 was employed was prepared. Then, the developing agents described in above Table 1 were applied to the image forming apparatus to perform the development of images.

Figure 14:
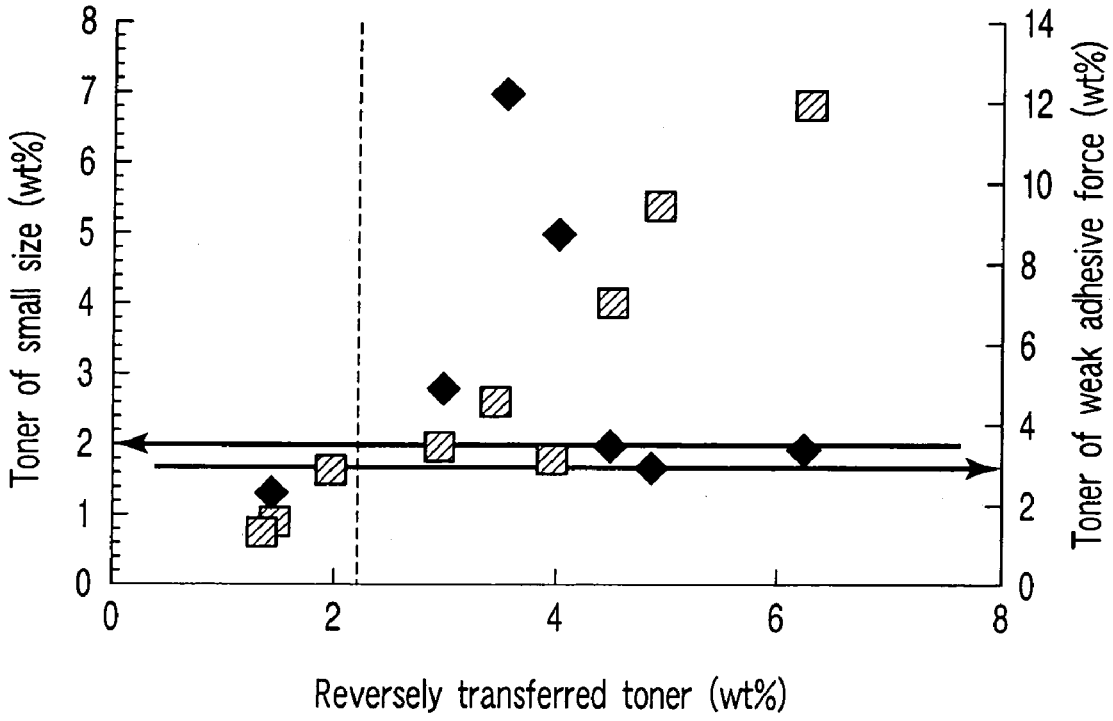
FIG. 14 is a graph illustrating the relationship between the quantity of reversely transferred toner and the quantity of toner of small particle size, as well as the relationship between the quantity of reversely transferred toner and the quantity of toner having a weak adhesive strength to an intermediate transferring body.

FIG. 14 shows a graph illustrating the relationship between the quantity of the toner that was reversely transferred to a photoreceptor of the succeeding station and the quantity of toner of small particle size, i.e. not more than 0.5 time as large as the 50% average particle diameter as well as the relationship between the quantity of the toner that was reversely transferred to a photoreceptor of the succeeding station and the quantity of toner having a weak adhesive strength to the intermediate transferring body, i.e. not more than $1.3\times10^{-8}$(N).

In FIG. 14, the symbol ♦ indicates the quantity of toner of small size and the symbol ■ indicates the quantity of toner having a weak adhesive strength. The plotted points which are the same in the scattering in concentration of fine line indicate the data of the same sample.

It was found that in order to confine the quantity of reverse transcription of toner to 2% by weight or less which is required to prevent the fluctuation of color in an image due to color mixture, the quantity of toner of small size should be confined to not more than 2% by weight and also the quantity of toner having a weak adhesive strength to a transferring medium should be confined to not more than 3% by weight.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus comprises an image carrier, a developing portion which feeds particles of developing agent to a electrostatic latent image to enable the developing agent to adhere onto the surface of an image carrier to form a developing agent image, and a transferring portion which transfers the developing agent image to a transferring medium;

wherein the ratio of the particles of developing agent having a particle diameter of not more than A×0.5 (μm) (wherein A is a 50% average particle diameter (μm)) and the ratio of the particles of developing agent having a particle diameter of not less than A×1.5 (μm) (wherein A is a 50% average particle diameter (μm)) are both confined to not more than 5% by number in a number particle size distribution;

the ratio of the developing agent having an adhesive strength of not more than $1.3\times10^{-8}$(N) is confined to 10% by weight or less and the ratio of the developing agent having an adhesive strength of not less than $3\times10^{-7}$(N) is confined to 5% by weight or less in a distribution of adhesive strength to the surface of the image carrier.

2. The image forming apparatus according to claim 1, wherein the transferring portion is further provided, at a latter stage thereof, with a cleaner which recovers a residual toner adhered on the surface of the image carrier.

3. An image forming apparatus comprises an image carrier, a developing portion which feeds particles of developing agent to an electrostatic latent image to enable the developing agent to adhere onto the surface of an image carrier to form a developing agent image, and a transferring portion which transfers the developing agent image to a transferring medium;

wherein the developing portion is further provided with a mechanism which recovers therein residual developing agent existing on the image carrier concurrent with the development;

the ratio of the particles of developing agent having a particle diameter of not more than A×0.5 (μm) where A is a 50% average particle diameter (μm), and the ratio of the particles of developing agent having a particle diameter of not less than A×1.5 (μm) where A is a 50% average particle diameter (μm), are both confined to not more than 4% by number in a number particle size distribution;

the ratio of the developing agent having an adhesive strength of not less than $3\times10^{-7}$(N) is confined to 4% by weight or less in a distribution of adhesive strength to the surface of the image carrier.

4. The image forming apparatus according to claim 3, wherein the ratio of the developing agent having an adhesive strength of not more than $1.3\times10^{-8}$(N) to the surface of image carrier is confined to 10% by weight or less.

5. A color image forming apparatus comprising image carriers, two or more developing portions which feeds plural kinds, differing in color, of developing agent to static latent images formed on the image carriers respectively to enable the developing agent to adhere onto the surface of each of image carriers to thereby form developing agent images differing in color, and transferring portions which transfers the developing agent images to each of transferring mediums;

wherein the ratio of the particles of developing agent having a particle diameter of not more than A×0.5 (μm) where A is a 50% average particle diameter (μm), is confined to not more than 3% by number in a number particle size distribution;

the ratio of the developing agent having an adhesive strength of not more than $1.3\times10^{-8}$(N) is confined to 5% by weight or less in a distribution of adhesive strength to the surface of the image carrier.

6. The color image forming apparatus according to claim 5, wherein the transferring portion is further provided, at a latter stage thereof, with at least one cleaner which recovers a residual toner adhered on the surface of the image carrier.

7. The color image forming apparatus according to claim 5, wherein the developing portion is further provided with a mechanism which recovers therein residual developing agent existing on the image carrier concurrent with the development;

the ratio of the particles of developing agent having a particle diameter of not more than A×0.5 (μm) (wherein A is a 50% average particle diameter (μm)) is confined to not more than 2% by number in the particles of developing;

the ratio of the developing agent having an adhesive strength of not more than $1.3\times10^{-8}$(N) is confined to 3% by weight or less in a distribution of adhesive strength to the surface of the image carrier.

8. The color image forming apparatus according to claim 5, wherein the ratio of the particles of developing agent having a particle diameter of not less than A×1.5 (μm) where A is a 50% average particle diameter (μm), is confined to not more than 5% by number in a number particle size distribution; the ratio of the developing agent having an adhesive strength of not less than $3\times10^{-7}$(N) is confined to 5% by weight or less in a distribution of adhesive strength to the surface of the image carrier.

9. A method of forming an image, which comprises developing an developing agent image on an image carrier by feeding particles of developing agent accommodated in a developing portion to a static latent image to enable the developing agent to adhere onto the surface of an image carrier, and transferring the developing agent image to a transferring medium;

wherein the ratio of the particles of developing agent having a particle diameter of not more than A×0.5 (μm) where A is a 50% average particle diameter (μm), and the ratio of the particles of developing agent having a particle diameter of not less than A×1.5 (μm) where A is a 50% average particle diameter (μm), are both confined to not more than 5% by number in a number particle size distribution;

the ratio of the developing agent having an adhesive strength of not more than $1.3\times10^{-8}$(N) is confined to 10% by weight or less and the ratio of the developing agent having an adhesive strength of not less than $3\times10^{-7}$(N) is confined to 5% by weight or less in a distribution of adhesive strength to the surface of the image carrier.

10. The method of forming an image according to claim 9, which further comprises recovering developing agent left remain on the image carrier subsequent to transfer the image.

11. A method of forming an image, which comprises developing an developing agent image on an image carrier by feeding particles of developing agent accommodated in a developing portion to a static latent image to enable the developing agent to adhere onto the surface of an image carrier, and transferring the developing agent image to a transferring medium;

wherein the developing further comprises recovering residual developing agent existing on the image carrier in the developing portion concurrent with the developing;

the ratio of the particles of developing agent having a particle diameter of not more than A×0.5 (μm) where A is a 50% average particle diameter (μm), and the ratio of the particles of developing agent having a particle diameter of not less than A×1.5 (μm) where A is a 50% average particle diameter (pm), are both confined to not more than 4% by number in a number particle size distribution;

the ratio of the developing agent having an adhesive strength of not less than $3\times10^{-7}$(N) is confined to 4% by weight or less in a distribution of adhesive strength to the surface of the image carrier.

12. A method of forming an image according to claim 11, wherein the ratio of the particles of developing agent having an adhesive strength of not more than $1.3\times10^{-8}$(N) to the surface of image carrier is confined to 10% by weight or less.

13. A method of forming a color image, which comprises: two or more steps of developing images of developing agents differing in color by feeding developing agents from two or more developing portions to static latent images, respectively, formed on the image carriers to enable the developing agent to adhere onto the surface of each of image carriers to form developing agent images differing in color, transferring the developing agent images differing in color to a transferring medium, and fixing the images of transferred developing agents on the transferring medium;

wherein the ratio of the particles of developing agent having a particle diameter of not more than A×0.5 (μm) (wherein A is a 50% average particle diameter (μm)) is confined to not more than 3% by number in a number particle size distribution;

the ratio of the developing agent having an adhesive strength of not more than $1.3\times10^{-8}$(N) is confined to 5% by weight or less in a distribution of adhesive strength to the surface of the image carrier.

14. The method of forming an image according to claim 13, which further comprises recovering developing agent left remain on the image carrier subsequent to the step of transferring the image.

15. The method of forming an image according to claim 13, wherein development further comprises recovering residual developing agent existing on the image carrier in the developing portion concurrent with the development;

the ratio of the particles of developing agent having a particle diameter of not more than A×0.5 (μm) (wherein A is a 50% average particle diameter (μm)) is confined to not more than 2% by number in a number particle size distribution, the ratio of the developing agent having an adhesive strength of not more than $1.3\times10^{-8}$(N) is confined to 3% by weight or less in a distribution of adhesive strength to the surface of the image carrier.

16. The method of forming an image according to claim 15, wherein the ratio of the particles of developing agent having a particle diameter of not less than A×1.5 (μm) (wherein A is a 50% average particle diameter (μm)) is confined to not more than 5% by number in a number particle size distribution; the ratio of the developing agent having an adhesive strength of not less than $3\times10^{-7}$(N) is confined to 5% by weight or less in a distribution of adhesive strength to the surface of the image carrier.

* * * * *